US011581678B2

(12) United States Patent
Tanaka

(10) Patent No.: US 11,581,678 B2
(45) Date of Patent: Feb. 14, 2023

(54) CONNECTOR WITH A LOCATOR TO POSITION AND PROPERLY BEND A CABLE DURING ASSEMBLY

(71) Applicant: Japan Aviation Electronics Industry, Limited, Tokyo (JP)

(72) Inventor: Masashi Tanaka, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 17/466,151

(22) Filed: Sep. 3, 2021

(65) Prior Publication Data

US 2022/0149560 A1 May 12, 2022

(30) Foreign Application Priority Data

Nov. 9, 2020 (JP) ..... JP2020-186441

(51) Int. Cl.
*H01R 13/516* (2006.01)
*H01R 4/2429* (2018.01)
(Continued)

(52) U.S. Cl.
CPC ..... *H01R 13/516* (2013.01); *H01R 4/2429* (2013.01); *H01R 13/5833* (2013.01); *H01R 13/629* (2013.01)

(58) Field of Classification Search
CPC ..... H01R 13/516; H01R 4/2429; H01R 13/5833; H01R 13/629; H01R 9/2416; H01R 4/2433; H01R 13/41; H01R 4/242
See application file for complete search history.

(56) References Cited

U.S. PATENT DOCUMENTS 6,866,538 B2 * 3/2005 Lee ..... H01R 12/675 439/417
7,465,183 B2 12/2008 Hashiguchi et al.
(Continued)

FOREIGN PATENT DOCUMENTS

CN 2596585 Y * 12/2003
EP 0620614 A1 * 10/1994
(Continued)

OTHER PUBLICATIONS

Machine Translation of JP 2004335221A (Nov. 25, 2004) (Year: 2022).*
(Continued)

*Primary Examiner* — Travis S Chambers
(74) *Attorney, Agent, or Firm* — Collard & Roe, P.C.

(57) ABSTRACT

A connector comprises a locator configured to position a cable. The locator has a front-end surface, a first surface and a second surface and is formed with a positioning groove. The first surface and the second surface are located at opposite sides of the locator, respectively, in the upper-lower direction (Z-direction). The positioning groove has a front groove, a rear groove and a coupling groove. The front groove is recessed rearward from the front-end surface and extends from the first surface to the coupling groove along the upper-lower direction. The rear groove is recessed from the second surface along the upper-lower direction and extends rearward from the coupling groove. When the locator positions the cable, the front groove receives a front regulated portion of the cable, and the rear groove receives a rear regulated portion of the cable.

9 Claims, 13 Drawing Sheets

(51) Int. Cl.
*H01R 13/629* (2006.01)
*H01R 13/58* (2006.01)

(56) References Cited

U.S. PATENT DOCUMENTS

| | | | | |
|---|---|---|---|---|
| 2008/0014801 | A1 * | 1/2008 | Milette | H01R 4/242 439/638 |
| 2017/0012374 | A1 | 1/2017 | Riccardi | |

FOREIGN PATENT DOCUMENTS

| | | | | |
|---|---|---|---|---|
| FR | 2 999 347 | A1 | 6/2014 | |
| JP | 2004335221 | A * | 11/2004 | H01R 12/675 |
| JP | 2008-098091 | A | 4/2008 | |
| JP | 4101344 | B2 * | 6/2008 | H01R 24/64 |
| WO | WO-2007075635 | A1 * | 7/2007 | H01R 9/2416 |

OTHER PUBLICATIONS

Machine Translation of JP 4101344B2 (Jun. 18, 2008) (Year: 2022).*
Machine Translation of EP 0620614A1 (Oct. 19, 1994) (Year: 2022).*
Machine Translation of CN 2596585Y (Dec. 31, 2003) (Year: 2022).*
European Search Report in 2119580.8-1201, dated Feb. 25, 2022.

* cited by examiner

CONNECTOR WITH A LOCATOR TO POSITION AND PROPERLY BEND A CABLE DURING ASSEMBLY

CROSS REFERENCE TO RELATED APPLICATIONS

This application is based on and claims priority under 35 U.S.C. § 119 to Japanese Patent Application No. JP 2020-186441 filed Nov. 9, 2020, the content of which is incorporated herein in its entirety by reference.

BACKGROUND OF THE INVENTION

This invention relates to a connector which comprises a locator for positioning a cable.

For example, this type of connector is disclosed in JPA 2008-098091 (Patent Document 1), the content of which is incorporated herein by reference.

Referring to FIG. 25, Patent Document 1 discloses a connector which comprises a locator 90 for positioning a plurality of cables 98. The locator 90 is provided with a plurality of recesses 92 and a plurality of comb-teeth 94. The recesses 92 correspond to the cables 98, respectively. Each of the cables 98 is received in the corresponding recess 92 and thereafter bent at right angle and held by two of the comb-teeth 94 which are adjacent to each other.

The locator of Patent Document 1 requires the cable to be bent along a wall surface of the locator. In an instance where the locator is small in size, excessive stress will be required in order to properly bend the cable. Therefore, the size of the locator should be made large to some extent in order for the cable to be bent with no damage of the cable. Thus, the structure of the locator of Patent Document 1 is unsuitable for reducing the size of the locator.

SUMMARY OF THE INVENTION

It is therefore an object of the present invention to provide a locator having a structure which enables a cable to be bent properly and enables the locator to be reduced in size.

An aspect of the present invention provides a connector configured to be connected to a cable. The connector comprises a housing, a contact and a locator configured to position the cable. The housing holds the contact and the locator. The contact has a connection portion. The connection portion is connectable with the cable, which is moved along a front-rear direction, through insulation displacement connection. The locator has a front-end surface, a first surface and a second surface and is formed with a positioning groove. The front-end surface is located at a front end of the locator. The first surface and the second surface are located at opposite sides of the locator, respectively, in an upper-lower direction perpendicular to the front-rear direction. The positioning groove has a front groove, a rear groove and a coupling groove. The front groove is recessed rearward from the front-end surface and extends from the first surface to the coupling groove along the upper-lower direction. The rear groove is recessed from the second surface toward the first surface along the upper-lower direction and extends rearward from the coupling groove to open rearward. The coupling groove opens forward and opens toward the second surface in the upper-lower direction. When the locator positions the cable, the front groove receives a front regulated portion which is a part of the cable, and the rear groove receives a rear regulated portion which is another part of the cable. The front groove, which receives the front regulated portion, regulates a rearward movement of the front regulated portion and regulates a movement of the front regulated portion in a lateral direction perpendicular to both the front-rear direction and the upper-lower direction. The rear groove, which receives the rear regulated portion, regulates a movement of the rear regulated portion toward the first surface and regulates another movement of the rear regulated portion in the lateral direction.

The positioning groove of the locator of an aspect of the present invention has the front groove which extends along the upper-lower direction, the rear groove which extends along the front-rear direction and the coupling groove which couples the front groove and the rear groove to each other. The cable can be smoothly and properly bent by only having it partially receptive into the positioning groove 70. In particular, even in an instance where the size of the locator is small, the cable can be properly bent with no exceed stress applied to the cable. Thus, an aspect of the present invention provides the locator having a structure which enables the cable to be bent properly and enables the locator to be reduced in size.

An appreciation of the objectives of the present invention and a more complete understanding of its structure may be had by studying the following description of the preferred embodiment and by referring to the accompanying drawings.

Figure 1:
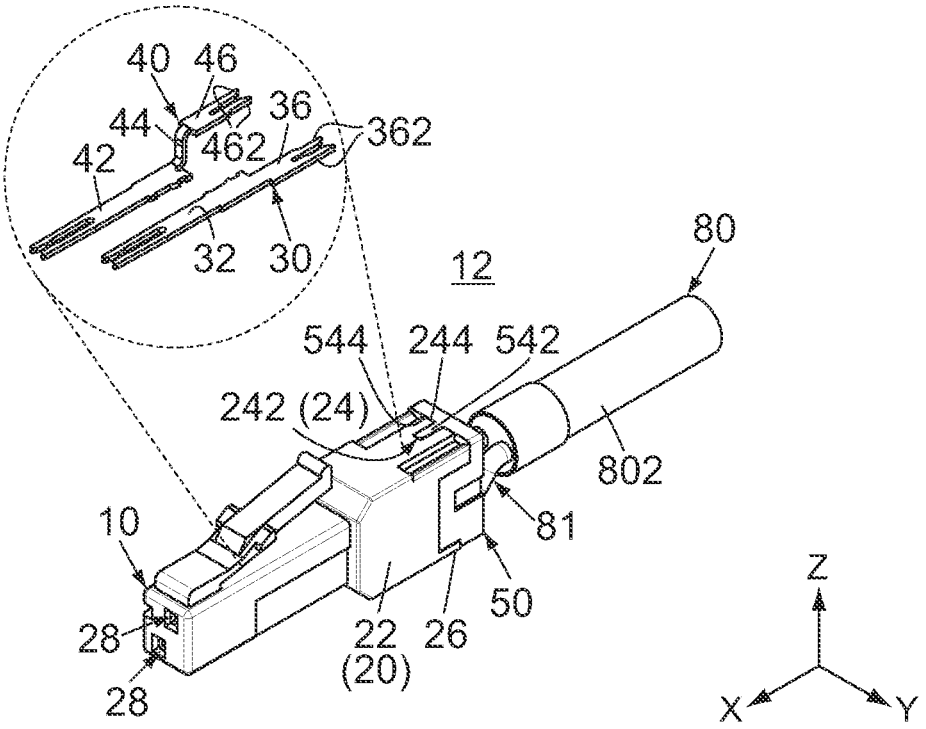
FIG. 1 is a perspective view showing a connector according to an embodiment of the present invention together with cables, wherein the connector is connected to the cables, and contacts held and hidden by a housing of the connector are illustrated in a dashed circle.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 2:
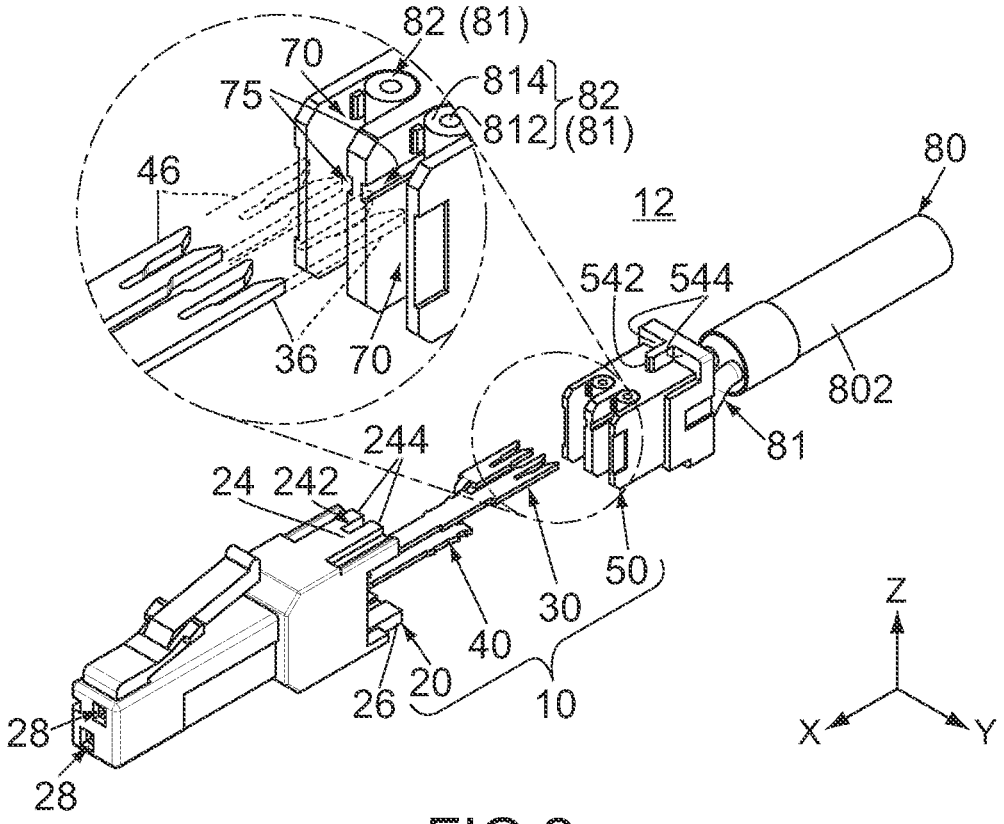
FIG. 2 is an exploded, perspective view showing the connector and the cables of FIG. 1, wherein a part of the connector enclosed by chain dotted lines are enlarged and illustrated, and in the enlarged view, outlines of connection portions of the contacts under a state where they are close to the cables are illustrated with dashed line.

Referring to FIGS. 1 and 2, a connector 10 according to an embodiment of the present invention is configured to be connected to two cables 81. The thus-connected connector 10 forms a harness 12 together with the cables 81 when used. Thus, the harness 12 of the present embodiment comprises the connector 10 and the cables 81. For each of the cables 81, one of opposite ends thereof is connected to the connector 10, and a remaining one of the opposite ends is connected to an electronic device (not shown).

The connector 10 of the present embodiment is a plug and is mateable with a mating connector (not shown), which is a receptacle, along a mating direction (front-rear direction: X-direction). When the connector 10 is mated with the mating connector, the electronic device (not shown) connected to the harness 12 is electrically connected with a mating electronic device (not shown) connected to the mating connector. The connector 10 of the present embodiment has the aforementioned structure and works as described above. However, the present invention is not limited thereto but is applicable to the various connectors 10. For example, the connector 10 may be a receptacle. Moreover, the mating direction is not limited to the X-direction.

Referring to FIG. 2, the two cables 81 of the present embodiment are covered with a jacket 802 made of insulator to form one cable structure 80. Each of the cables 81 has a core wire 812 made of conductor and a coat 814 made of insulator. Each of the coats 814 covers the core wire 812. One of the opposite ends of each of the cables 81 is exposed from the jacket 802 and extends forward, or in the positive X-direction. Each of the cable structure 80 and the cables 81 of the present embodiment has the aforementioned structure. However, the present invention is not limited thereto. For example, the number of the cables 81 included in the cable structure 80 may be one or may be three or more. The cable structure 80 is not specifically limited, provided that each of the cables 81 has the core wire 812 covered with the coat 814.

Referring to FIGS. 1 and 2, the connector 10 of the present embodiment comprises a housing 20 made of insulator, two contacts 30 and 40 each made of conductor and a locator 50 made of insulator. The locator 50 is configured to position the two cables 81. The two contacts 30 and 40 are provided so as to correspond to the two cables 81, respectively. The housing 20 holds the contacts 30 and 40 and the locator 50. The connector 10 of the present embodiment comprises only the aforementioned members. However, the present invention is not limited thereto. For example, the connector 10 may comprise a shell made of metal in addition to the aforementioned members. The shell may cover the housing 20. Moreover, the number of the contacts may be equal to the number of the cables 81. For example, when the number of the cables 81 is one, the number of the contacts will be one.

Hereafter, explanation will be made about the housing 20 and the contacts 30 and 40 of the present embodiment.

Figure 3:
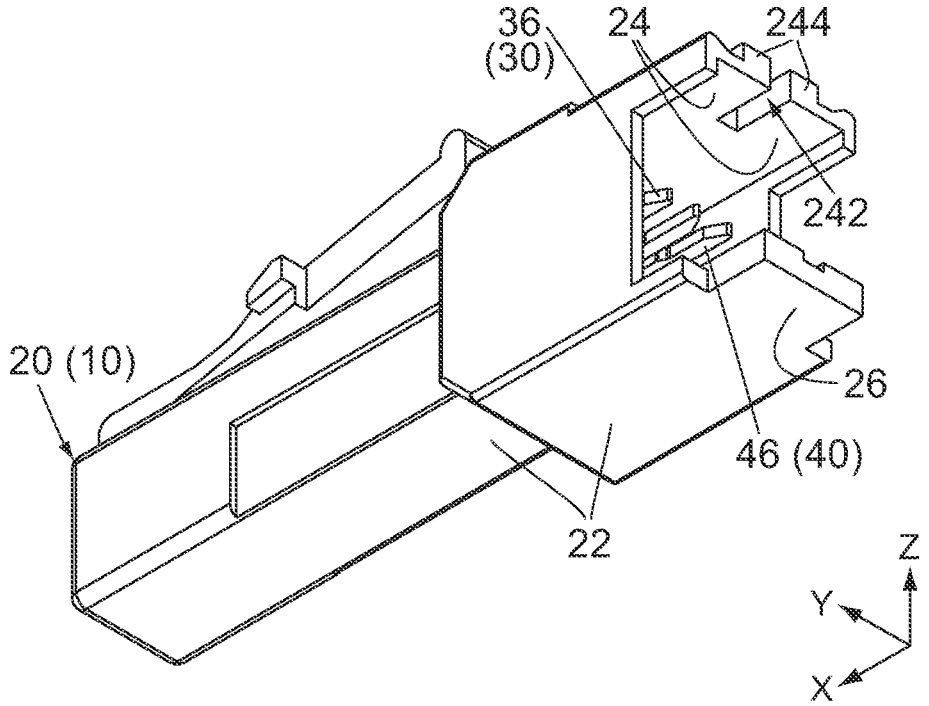
FIG. 3 is a perspective view showing the housing of the connector of FIG. 1.

As shown in FIGS. 2 and 3, the housing 20 of the present embodiment has a body 22, a first protruding portion 24 and a second protruding portion 26. The body 22 extends along the X-direction. Each of the first protruding portion 24 and the second protruding portion 26 has a flat-plate shape in parallel to a horizontal plane (XY-plane). The first protruding portion 24 and the second protruding portion 26 protrude rearward, or in the negative X-direction, from a rear end (negative X-side end) of the body 22. The first protruding portion 24 and the second protruding portion 26 are located at opposite sides of the body 22, respectively, in an upper-lower direction (Z-direction) perpendicular to the X-direction. More specifically, the first protruding portion 24 is located at an upper end (positive Z-side end) of the body 22, and the second protruding portion 26 is located at a lower end (negative Z-side end) of the body 22.

The housing 20 of the present embodiment is an integrally formed member. In other words, each of the body 22, the first protruding portion 24 and the second protruding portion 26 is a part of a unitary member. However, the present invention is not limited thereto. For example, the housing 20 may be formed of two or more members which are combined to each other. The housing 20 may further have another portion in addition to the aforementioned portions.

The housing 20 of the present embodiment is formed with a guide portion 242. The guide portion 242 is a recess which is formed in the first protruding portion 24. The guide portion 242 is recessed forward from a rear end of the first protruding portion 24 and opens upward, or in the positive Z-direction, and downward, or in the negative Z-direction. The guide portion 242 has a length, i.e., a size in the X-direction, which is larger than a width, i.e., a size in a lateral direction (Y-direction) perpendicular to both the X-direction and the Z-direction, of the guide portion 242. In other words, the guide portion 242 extends long in the X-direction.

The housing 20 of the present embodiment has two catch portions 244. Each of the catch portions 244 is a part of a rear surface (negative X-side surface) of the first protruding portion 24 and faces rearward. Each of the catch portions 244 extends along a predetermined plane (YZ-plane) perpendicular to the X-direction. The two catch portions 244 are arranged in the Y-direction while the guide portion 242 is located therebetween.

Referring to FIG. 1, the contact 30 of the present embodiment is formed of a single metal plate with no bend and has a front portion 32 and a connection portion 36. The front portion 32 is a front part (positive X-side part) of the contact 30. The connection portion 36 extends rearward from a rear end of the front portion 32. The connection portion 36 has two connection pieces 362. The two connection pieces 362 are arranged in the Y-direction with a slight distance therebetween.

The contact 40 of the present embodiment is formed of a single metal plate with bends and has a front portion 42, a coupling portion 44 and a connection portion 46. The front portion 42 is a front part of the contact 40. The coupling portion 44 extends upward as a whole from a rear end of the front portion 42. The connection portion 46 extends rearward from an upper end of the coupling portion 44. Thus, the coupling portion 44 couples the front portion 42 and the connection portion 46 to each other. The connection portion 46 has two connection pieces 462. The two connection pieces 462 are arranged in the Y-direction with a slight distance therebetween.

Figure 7:
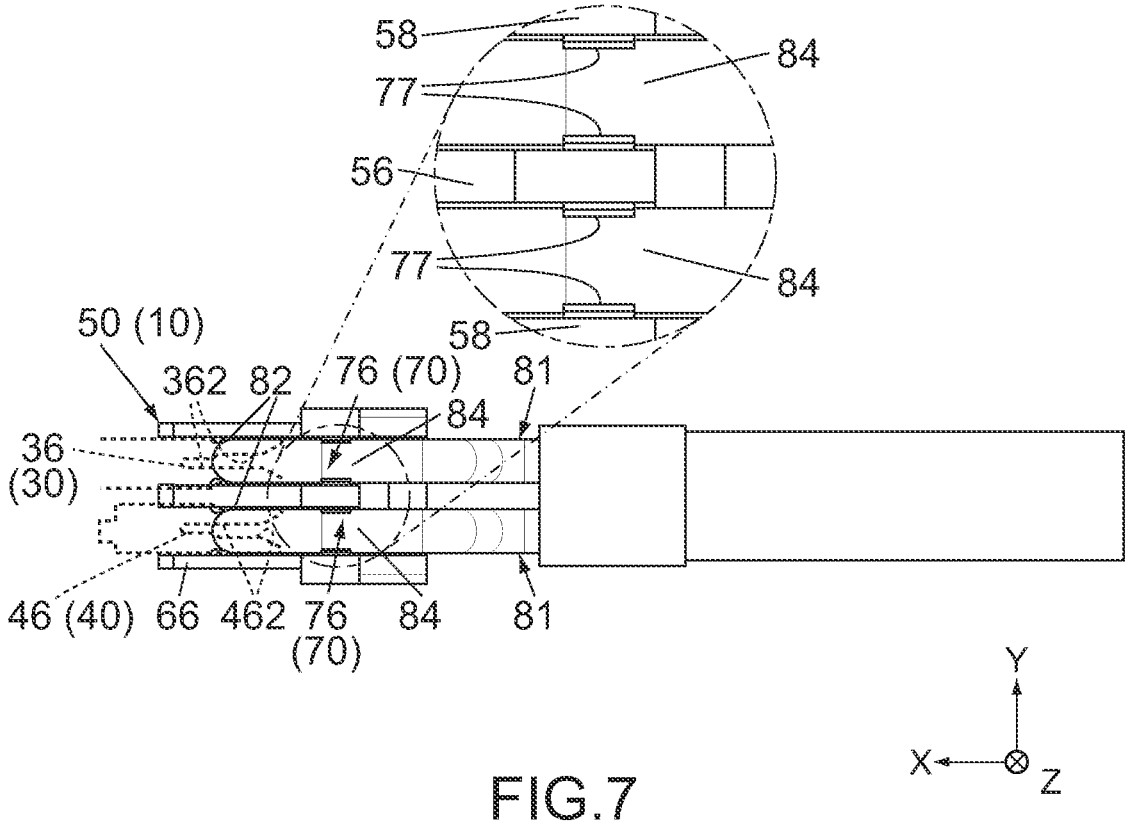
FIG. 7 is a bottom view showing the locator and the cables of FIG. 4, wherein outlines of the connection portions of the contacts under a state where they are connected to the cables through insulation displacement connection are illustrated with dashed line, and a part of the locator enclosed by chain dotted lines is enlarged and illustrated.

Referring to FIG. 3, the connection portion 36 of the contact 30 and the connection portion 46 of the contact 40 are located at positions same as each other in the Z-direction and are arranged in the Y-direction. Referring to FIG. 7 together with FIG. 2, the connection portions 36 and 46 are provided so as to correspond to the two cables 81, respectively. When a part of the cable 81 which extends along the Z-direction is moved toward the connection portion 36 or 46 along the X-direction from behind, the two connection pieces 362 or the two connection pieces 462 break the coat 814 of the cable 81 and thereafter sandwich and hold the core wire 812 in the Y-direction. In other words, each of the connection portions 36 and 46 of the present embodiment is connectable to the cable 81, which is moved along the X-direction, through insulation displacement connection.

Each of the contacts 30 and 40 of the present embodiment is a pin contact or a male contact which has the aforementioned structure. However, the present invention is not limited thereto. For example, each of the contacts 30 and 40 may be a socket contact or a female contact. The structure of each of the connection portions 36 and 46 is not specifically limited, provided that each of the contacts 30 and 40 is connectable to the corresponding cable 81 through insulation displacement connection. When the cable structure 80 comprises only one of the cables 81, the connector 10 may comprise only one of the contacts 30 and 40.

As shown in FIG. 1, the body 22 of the housing 20 is formed with two connection holes 28. Each of the connection holes 28 is a hole which is formed in a front end (positive X-side end) of the body 22. The two connection holes 28 are located at positions different from each other in each of the Y-direction and the Z-direction.

The front portion 42 of the contact 40 is located below the front portion 32 of the contact 30. The front portions 32 and 42 are arranged in the housing 20 and are held by the housing 20. The front portion 32 is located at a position same as that of the upper (positive Z-side) connection hole 28 in the YZ-plane. The front portion 42 is located at a position same as that of the lower (negative Z-side) connection hole 28 in the YZ-plane. Under a mated state where the connector 10 and the mating connector (not shown) are mated with each other, two mating contacts (not shown) of the mating connector are received in the connection holes 28, respectively, and are brought into contact with the front portions 32 and 42, respectively.

Hereafter, explanation will be made about the locator 50 of the present embodiment.

Figure 8:
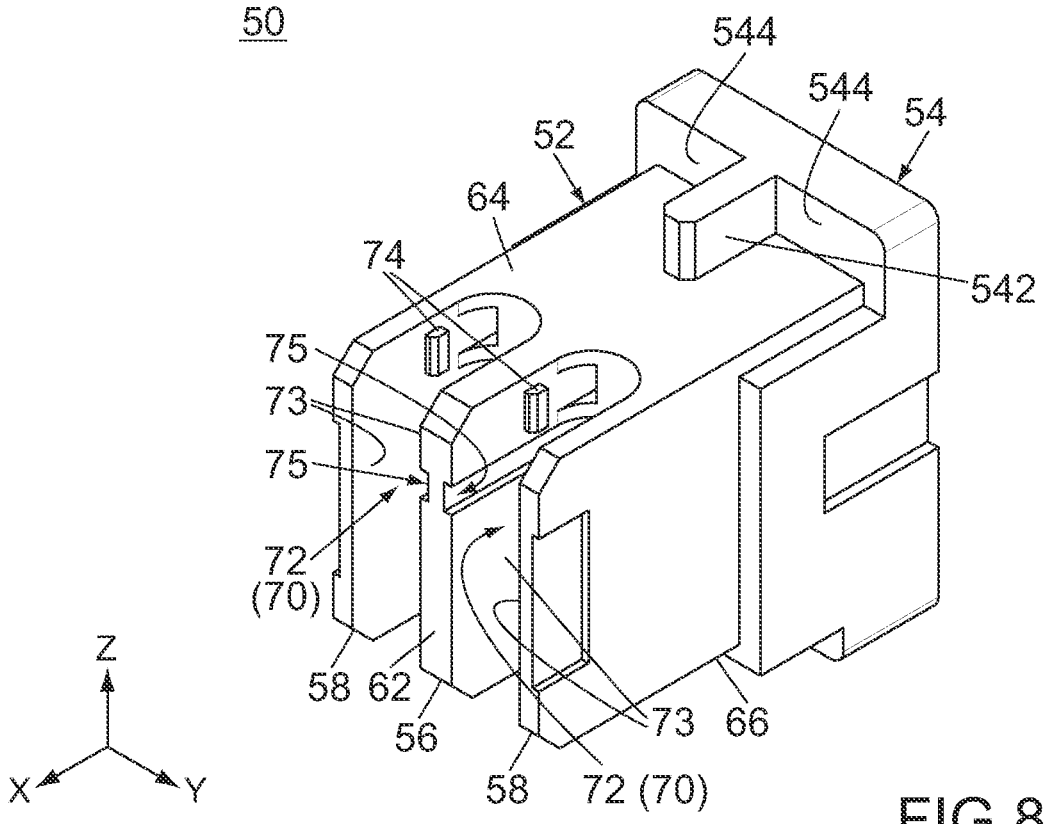
FIG. 8 is a perspective view showing the locator of FIG. 4.
Figure 9:
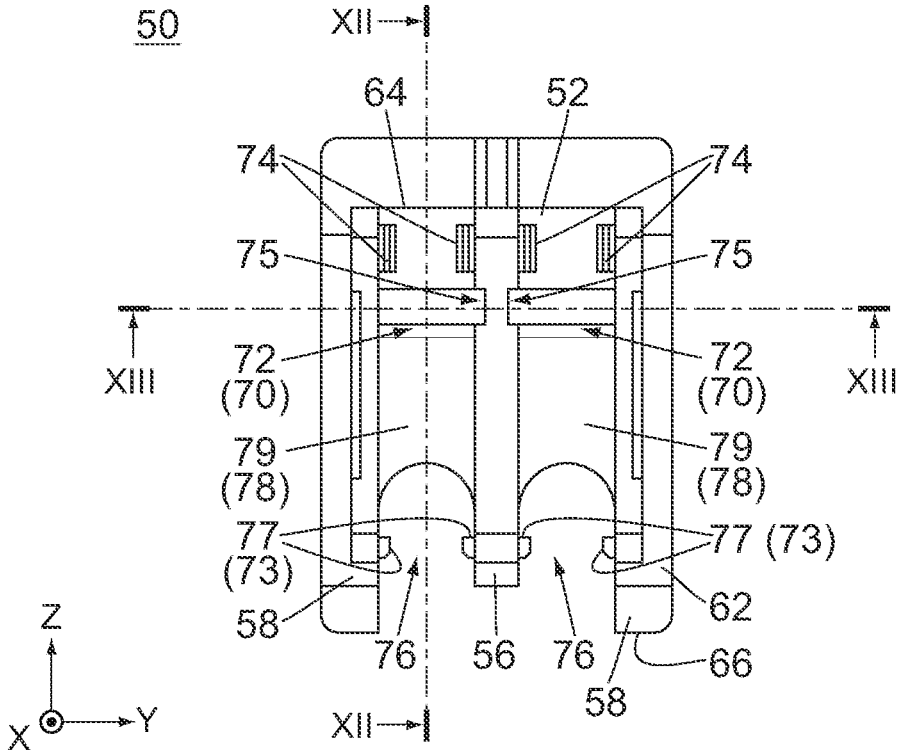
FIG. 9 is a front view showing the locator of FIG. 8.
Figure 10:
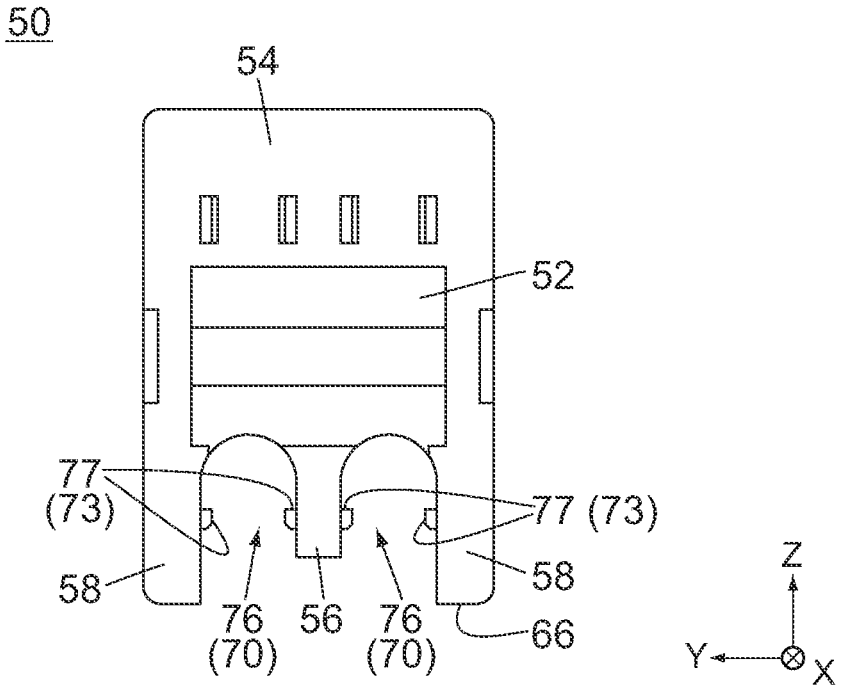
FIG. 10 is a rear view showing the locator of FIG. 8.

Referring to FIG. 8, the locator 50 of the present embodiment has a base portion 52, a rear portion 54, a middle plate 56 and two side plates 58. The base portion 52 has a block shape. The rear portion 54 is located rearward of the base portion 52. Each of the middle plate 56 and the side plates 58 has a flat-plate shape in parallel to a vertical plane (XZ-plane) defined by the X-direction and the Z-direction. The middle plate 56 and the side plates 58 are arrange in the Y-direction while they are apart from each other. The middle plate 56 is located at a middle position between the two side plates 58 in the Y-direction. Referring to FIGS. 8 and 9, each of the middle plate 56 and the side plates 58 protrudes forward and downward from the base portion 52.

Figure 11:
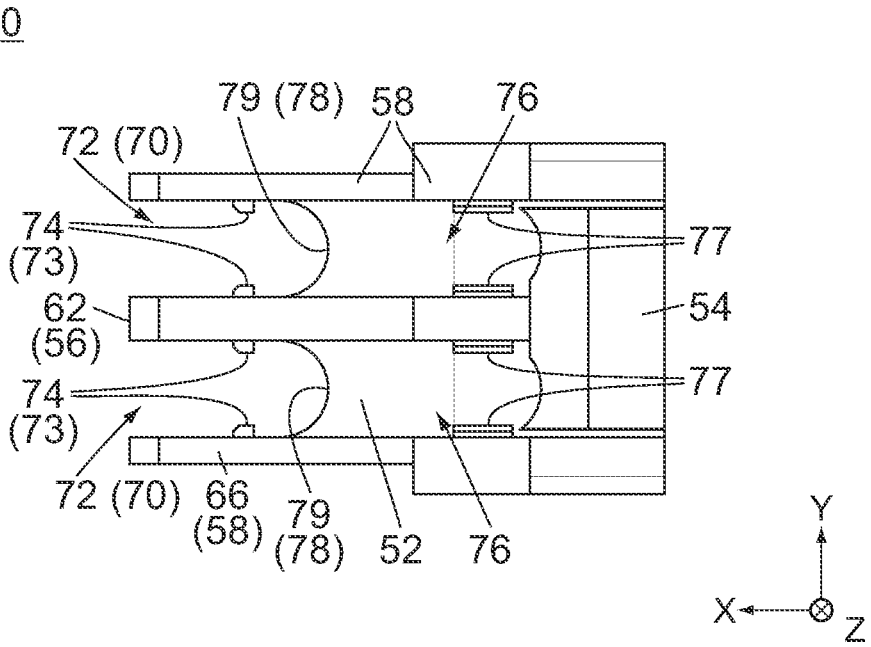
FIG. 11 is a bottom view showing the locator of FIG. 8.

Referring to FIGS. 8, 9 and 11, the locator 50 has a front-end surface 62. The front-end surface 62 is located at a front end of the locator 50. The front-end surface 62 of the present embodiment includes a front surface (positive X-side surface) of the middle plate 56 and front surfaces of the side plates 58. According to the present embodiment, the front surfaces of the middle plate 56 and the side plates 58 are located at positions same as each other in the X-direction. Thus, the position of the front-end surface 62 in the X-direction is constant regardless of its position in the Y-direction. However, the present invention is not limited thereto. For example, the front surfaces of the middle plate 56 and the side plates 58 may be located at positions different from each other in the X-direction. In other words, the position of the front-end surface 62 in the X-direction may vary depending on its position in the Y-direction. Moreover, the front-end surface 62 may be a front surface of a part which is neither the middle plate 56 nor the side plate 58.

The locator 50 has a first surface 64 and a second surface 66 in addition to the front-end surface 62. The first surface 64 and the second surface 66 are located at opposite sides of the locator 50 in the Z-direction, respectively. The first surface 64 of the present embodiment includes an upper surface (positive Z-side surface) of the base portion 52, an upper surface of the middle plate 56 and upper surfaces of the side plates 58 of the locator 50. The second surface 66 of the present embodiment includes a lower surface (negative Z-side surface) of the middle plate 56 and lower surfaces of the side plates 58 of the locator 50. However, the present invention is not limited thereto. For example, referring to FIG. 2, the locator 50 may have a structure which is vertically inverted with respect to the housing 20. Thus, referring to FIG. 8, the first surface 64 may include the lower surfaces of the base portion 52, the middle plate 56 and the side plates 58 of the locator 50. The second surface 66 may include the upper surfaces of the middle plate 56 and the side plates 58 of the locator 50.

As shown in FIG. 8, the rear portion 54 of the locator 50 of the present embodiment protrudes outward in the Z-direction from the first surface 64 of the base portion 52. More specifically, the rear portion 54 protrudes upward beyond the first surface 64.

The locator 50 of the present embodiment is an integrally formed member and has the aforementioned structure. However, the present invention is not limited thereto. For example, the locator 50 may be formed of two or more members which are combined to each other. The structure of the locator 50 can be variously modified as necessary.

Figure 4:
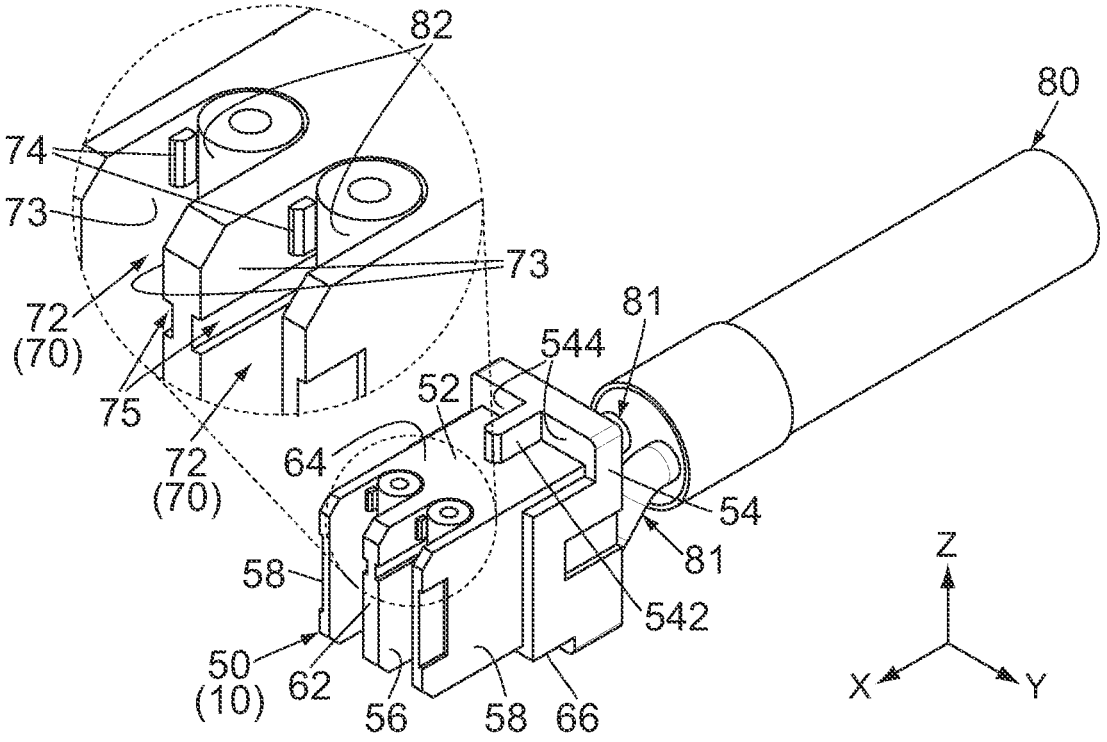
FIG. 4 is a perspective view showing a locator of the connector of FIG. 1 together with the cables, wherein the locator positions the cables, and a part of the locator enclosed by dashed line is enlarged and illustrated.

Referring to FIG. 4, the locator 50 of the present embodiment is formed with a positioning groove 70. The positioning groove 70 of the present embodiment includes two positioning grooves 70 which correspond to the two cables 81, respectively. Each of the positioning grooves 70 is a portion for positioning the corresponding cable 81 to the connector 10. Therefore, the number of the positioning grooves 70 should be equal to the number of the cables 81. For example, when the number of the cables 81 is one, the locator 50 may be formed with only one of the positioning grooves 70.

Referring to FIGS. 8 to 11, the two positioning grooves 70 of the present embodiment are arranged in the Y-direction. The two positioning grooves 70 of the present embodiment have structures same as each other. Hereafter, explanation will be made about the structure of one of the positioning grooves 70. The explanation described below is applicable to each of the positioning grooves 70.

Figure 6:
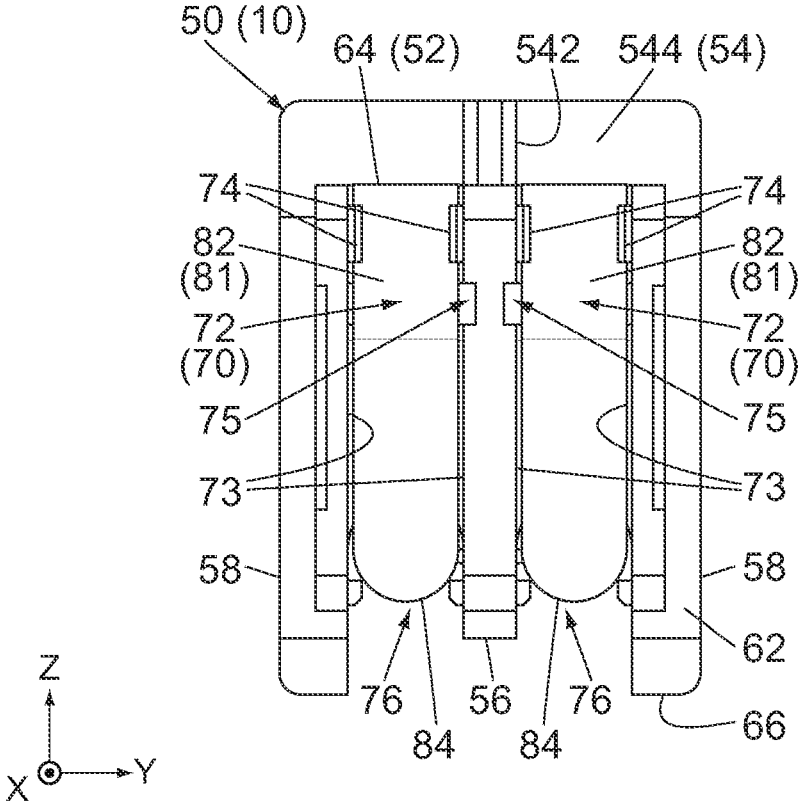
FIG. 6 is a front view showing the locator and the cables of FIG. 4.

Referring to FIGS. 8, 9 and 11, the positioning groove 70 is a groove which is located between the middle plate 56 and one of the side plates 58. The positioning groove 70 extends around the base portion 52 in the XZ-plane. The positioning groove 70 is located between two inner walls 73 in the Y-direction. One of the inner walls 73 is a side surface of the middle plate 56. A remaining one of the inner walls 73 is a side surface of the side plate 58. Referring to FIG. 6, the positioning groove 70 has a size in the Y-direction which is slightly larger than a wire diameter of the cable 81, i.e., a size of the cable 81 in the Y-direction.

Figure 12:
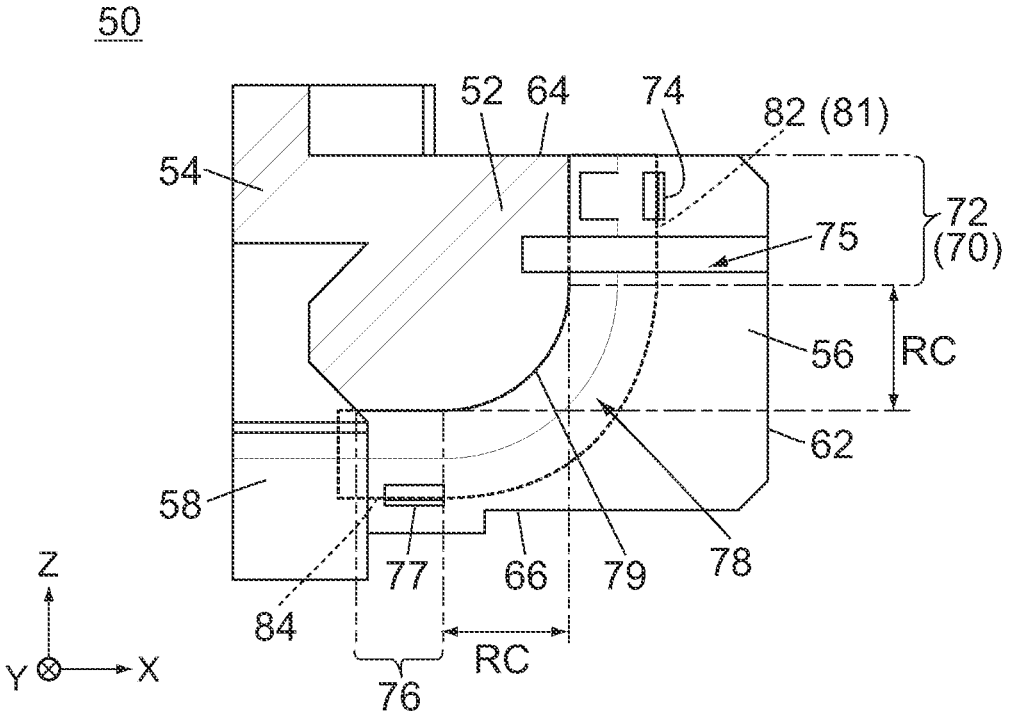
FIG. 12 is a cross-sectional view showing the locator of FIG. 9, taken along line XII-XII, wherein an outline of a part of the cable is illustrated with dashed line.

Referring to FIG. 12, the positioning groove 70 has a front groove 72, a rear groove 76 and a coupling groove 78. The front groove 72 is a front part of the positioning groove 70. The front groove 72 extends along the Z-direction and opens at the first surface 64. The rear groove 76 is a rear part (negative X-side part) of the positioning groove 70. The rear groove 76 extends along the X-direction and opens rearward. The coupling groove 78 is a middle part of the positioning groove 70 and couples the front groove 72 and the rear groove 76 to each other. Thus, the front groove 72 extends from the first surface 64 to the coupling groove 78 along the Z-direction. The rear groove 76 extends rearward from the coupling groove 78 to open rearward.

Referring to FIGS. 8 and 12, the front groove 72 is recessed rearward from the front-end surface 62 to the base portion 52. Referring to FIGS. 11 and 12, the rear groove 76 is recessed from the second surface 66 toward the first surface 64 in the Z-direction. The rear groove 76 is recessed to the base portion 52 in the Z-direction. Thus, referring to FIG. 12, each of the front groove 72 and the rear groove 76 is a recess with a bottom. The coupling groove 78 opens forward and opens toward the second surface 66 in the Z-direction. The front groove 72 opens forward over its entire length. The rear groove 76 opens toward the second surface 66 over its entire length.

According to the structure described above, the positioning groove 70 of the present embodiment opens outward of the locator 50 over its entire length. Therefore, when the locator 50 alone, i.e., the locator 50 which does not position the cables 81 and is not attached to the housing 20 (see FIG. 2), is seen from the front, the front groove 72 is visible, and the rear groove 76 is visible through the coupling groove 78. When the locator 50 alone is seen from the second surface 66 along the Z-direction, the rear groove 76 is visible, and the front groove 72 is visible through the coupling groove 78.

Referring to FIG. 2, upon fabrication of the connector 10, first, the cables 81 are received in the positioning grooves 70 of the locator 50, respectively, to be positioned. The positioning groove 70 of the present embodiment has the aforementioned structure so that the cable 81 is easily received therein upon positioning the cable 81. However, the present invention is not limited thereto. For example, the locator 50 may have a part which covers a part of the front groove 72 from the front.

Hereafter, explanation will be made about one of the positioning grooves 70 which receives the cable 81. The explanation described below is applicable to each of the positioning grooves 70.

Referring to FIGS. 4, 6 and 7, when the cable 81 is positioned by the locator 50, a part of the cable 81 is inserted into the positioning groove 70. In detail, when the locator 50 positions the cable 81, the front groove 72 receives a front regulated portion 82 which is a part of the cable 81, and the rear groove 76 receives a rear regulated portion 84 which is another part of the cable 81. The rear regulated portion 84 received in the rear groove 76 is located rearward of the front regulated portion 82 received in the front groove 72. When the front regulated portion 82 is received in the front groove 72, an end portion of the cable 81 may project upward from the front groove 72. In this instance, the end portion of the cable 81 may be cut out.

Referring to FIG. 6 together with FIG. 9, the front regulated portion 82, which is received in the front groove 72, is in contact with the base portion 52 in the X-direction or is located forward of the base portion 52 with a slight distance therefrom. In addition, the front regulated portion 82, which is received in the front groove 72, is located between the middle plate 56 and the side plate 58 in the Y-direction with a slight distance therefrom. If the front regulated portion 82 is moved rearward, the front regulated portion 82 is brought into abutment with the base portion 52. If the front regulated portion 82 is moved in the Y-direction, the front regulated portion 82 is brought into abutment with the middle plate 56 or the side plate 58. Thus, the front groove 72, which receives the front regulated portion 82, regulates a rearward movement of the front regulated portion 82 and regulates a movement of the front regulated portion 82 in the Y-direction.

Referring to FIG. 7 together with FIG. 11, the rear regulated portion 84, which is received in the rear groove 76, is in contact with the base portion 52 in the Z-direction or is located between the base portion 52 and the second surface 66 with a slight distance from the base portion 52. In addition, the rear regulated portion 84, which is received in the rear groove 76, is located between the middle plate 56 and the side plate 58 in the Y-direction with a slight distance therefrom. If the rear regulated portion 84 is moved toward the first surface 64 (see FIG. 8), the rear regulated portion 84 is brought into abutment with the base portion 52. If the rear regulated portion 84 is moved in the Y-direction, the rear regulated portion 84 is brought into abutment with the middle plate 56 or the side plate 58. Thus, the rear groove 76, which receives the rear regulated portion 84, regulates a movement of the rear regulated portion 84 toward the first surface 64 and regulates another movement of the rear regulated portion 84 in the Y-direction.

Referring to FIG. 12, as described above, the positioning groove 70 of the locator 50 of the present embodiment has the front groove 72 which extends along the Z-direction, the rear groove 76 which extends along the X-direction and the coupling groove 78 which couples the front groove 72 and the rear groove 76 to each other. The cable 81 can be smoothly and properly bent by only having it partially receptive into the positioning groove 70. In particular, even in an instance where the size of the locator 50 is small, the cable 81 can be properly bent with no exceed stress applied to the cable 81. Thus, the present embodiment provides the locator 50 having a structure which enables the cable 81 to be bent properly and enables the locator 50 to be reduced in size.

The coupling groove 78 of the present embodiment has a bottom surface 79. The bottom surface 79 is a wall surface of the base portion 52 in the XZ-plane. The bottom surface 79 is located rearward of the front groove 72 and is nearer to the first surface 64 in the Z-direction than the rear groove 76 is. The bottom surface 79 of the present embodiment has an arc shape in the XZ-plane. The arc of the bottom surface 79 has a radius RC which is larger than a size of the front regulated portion 82 of the cable 81 in the X-direction, i.e., the wire diameter of the cable 81. According to this structure, the cable 81 can be smoothly and properly bent along the bottom surface 79. However, the present invention is not limited thereto. For example, the shape of the bottom surface 79 in the XZ-plane is not limited to the arc shape but may be a rounded shape such as an elliptical arc shape. The radius RC of the arc of the bottom surface 79 may be designed depending on requirement.

Referring to FIGS. 8 and 9, the front groove 72 of the present embodiment is provided with two front holding portions 74. The front holding portions 74 are protrusions which are formed on the two inner walls 73 of the positioning groove 70, respectively. Each of the front holding portions 74 protrudes from the inner wall 73 into the front groove 72 in the Y-direction and extends along the Z-direction. Referring to FIGS. 4 and 6, when the front groove 72 receives the front regulated portion 82 of the cable 81, the front holding portions 74 hold the front regulated portion 82. In detail, the front regulated portion 82 is sandwiched and held between the base portion 52 and each of the front holding portions 74 in the X-direction, so that the front regulated portion 82 is kept in a state of being received in the front groove 72.

Referring to FIGS. 9 and 11, the rear groove 76 of the present embodiment is provided with two rear holding portions 77. The rear holding portions 77 are protrusions which are formed on the two inner walls 73 of the positioning groove 70, respectively. Each of the rear holding portions 77 protrudes from the inner wall 73 into the rear groove 76 in the Y-direction and extends along the X-direction. Referring to FIGS. 6 and 7, when the rear groove 76 receives the rear regulated portion 84 of the cable 81, the rear holding portions 77 hold the rear regulated portion 84. In detail, the rear regulated portion 84 is sandwiched and held between the base portion 52 and each of the rear holding portions 77 in the Z-direction, so that the rear regulated portion 84 is kept in a state of being received in the rear groove 76.

Referring to FIGS. 4 and 6, according to the present embodiment, since the front holding portions 74 and the rear holding portions 77 are provided, the cable 81 can be kept in a predetermined position without using a temporarily holding member (not shown) such as a tape. However, the present invention is not limited thereto. For example, the cable 81 may be temporarily kept in the predetermined position by using a temporarily holding member instead of the front holding portions 74 and the rear holding portions 77. Thus, the front holding portions 74 and the rear holding portions 77 may be provided as necessary. Each of the number of the front holding portions 74 and the number of the rear holding portions 77 is not limited to two. The structure of each of the front holding portions 74 and the rear holding portions 77 is not specifically limited, provided that the cable 81 can be held.

Referring to FIG. 2, the locator 50 which positions the cable 81 is moved forward to be inserted into the housing 20 and is thereby attached to the housing 20. Hereafter, explanation will be made about an attachment operation of the locator 50 to the housing 20.

As shown in FIG. 8, the locator 50 of the present embodiment has a guided portion 542. The guided portion 542 is a protruding portion which is formed on the first surface 64 of the base portion 52. The guided portion 542 protrudes outward in the Z-direction from the first surface 64 and extends forward from a front end of the rear portion 54. Referring to FIG. 1, the guided portion 542 is located at a position same as that of the guide portion 242 of the housing 20 in the YZ-plane. The guided portion 542 has a length, i.e., a size in the X-direction, which is slightly smaller than a length, i.e., a size in the X-direction, of the guide portion 242. The guided portion 542 has a width, i.e., a size in the Y-direction, which is slightly smaller than a width, i.e., a size in the Y-direction, of the guide portion 242.

Referring to FIGS. 1 and 2, when the locator 50 is moved toward the housing 20, the locator 50 is vertically sandwiched between the first protruding portion 24 and the second protruding portion 26 of the housing 20 to be positioned relative to the housing 20 in the Z-direction. When the movement of the locator 50 is continued, the locator 50 is partially received in the housing 20 to be positioned relative to the housing 20 in the YZ-plane. When the movement of the locator 50 is further continued, the guided portion 542 is received in the guide portion 242 so that the locator 50 is inserted into the housing 20 with no displacement in the Y-direction.

As described above, the connector 10 of the present embodiment has a positioning mechanism which accurately positions the locator 50 to the housing 20. The positioning mechanism of the present embodiment includes the guide portion 242 of the housing 20 and the guided portion 542 of the locator 50. However, the present invention is not limited thereto, but the positioning mechanism of the connector 10 can be variously modified as necessary.

Figure 13:
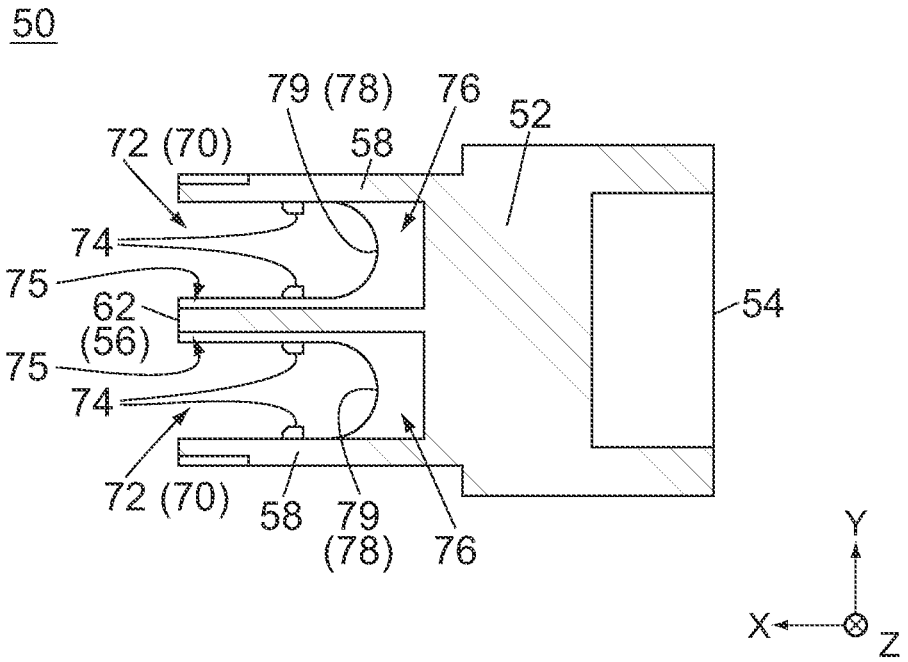
FIG. 13 is a cross-sectional view showing the locator of FIG. 9, taken along line XIII-XIII.

Referring to FIGS. 4 and 6, the locator 50 of the present embodiment is formed with two guide channels 75. The two guide channels 75 are provided so as to correspond to the two front grooves 72, respectively. Each of the guide channels 75 is formed in one of the inner walls 73 of the corresponding front groove 72 in the Y-direction. Referring to FIG. 13, each of the guide channels 75 is recessed in the Y-direction and extends along the X-direction.

Referring to FIG. 2, the two guide channels 75 are provided so as to correspond to the connection portions 36 and 46 of the two contacts 30 and 40, respectively. Upon insertion of the locator 50 into the housing 20, each of the guide channels 75 partially receives the corresponding connection portion 36 or 46 and guides it to the front regulated portion 82 of the corresponding cable 81 along the X-direction. Thus, each of the guide channels 75 is a portion for guiding the connection portion 36 or 46 of the contact 30 or 40.

Referring to FIG. 7, when the locator 50 is attached to the housing 20 (see FIG. 2), each of the connection portions 36 and 46 has been guided to the corresponding front regulated portion 82 to be connected to the corresponding front regulated portion 82 through insulation displacement connection.

Referring to FIG. 2, according to the present embodiment, since each of the front grooves 72 is provided with the guide channel 75 which extends straight in the X-direction, each of the connection portions 36 and 46 can be accurately guided to the corresponding front regulated portion 82 to be reliably connected to the cable 81 through insulation displacement connection. However, the present invention is not limited thereto. For example, the guide channels 75 may be provided as necessary. The number and the arrangement of the guide channels 75 of each of the front grooves 72 can be modified as necessary. The structure of each of the guide channels 75 is not specifically limited, provided that the corresponding connection portion 36 or 46 can be guided.

Referring to FIG. 8, the locator 50 of the present embodiment has two abutment portions 544. Each of the abutment portions 544 is a front surface of a part of the rear portion 54 of the locator 50 which protrudes beyond the first surface 64. Each of the abutment portions 544 is located rearward of the front groove 72 and protrudes outward in the Z-direction from the first surface 64. Thus, each of the abutment portions 544 is located in the vicinity of a rear end of the locator 50 and is located in the vicinity of an upper end of the locator 50. Each of the abutment portions 544 faces forward and extends along the YZ-plane. The two abutment portions 544 are arranged in the Y-direction while the guided portion 542 is located therebetween.

Referring to FIG. 2, the two abutment portions 544 are provided so as to correspond to the catch portions 244 of the housing 20, respectively. During the insertion of the locator 50 into the housing 20, each of the abutment portions 544 faces the corresponding catch portion 244 in the X-direction. Referring to FIG. 1, when the insertion of the locator 50 into the housing 20 is continued, each of the abutment portions 544 is brought into abutment with the corresponding catch portion 244. At that time, the locator 50 is attached to and held by the housing 20. When the locator 50 is attached to the housing 20, the catch portions 244 face the abutment portions 544 in the X-direction, respectively.

Each of the connection portions 36 and 46 is moved relative to the locator 50 along a moving path. Each of the abutment portions 544 of the present embodiment is arranged in the vicinity of the moving path in the XY-plane. According to this arrangement, an operator can connect each of the connection portions 36 and 46 to the cable 81 through insulation displacement connection by merely pushing the locator 50 into the housing 20. However, the present invention is not limited thereto. For example, the number and the arrangement of the abutment portions 544 are not specifically limited. The structure of each of the abutment portions 544 is not specifically limited.

The present embodiment can be further variously modified in addition to the already described modifications.

Figure 5:
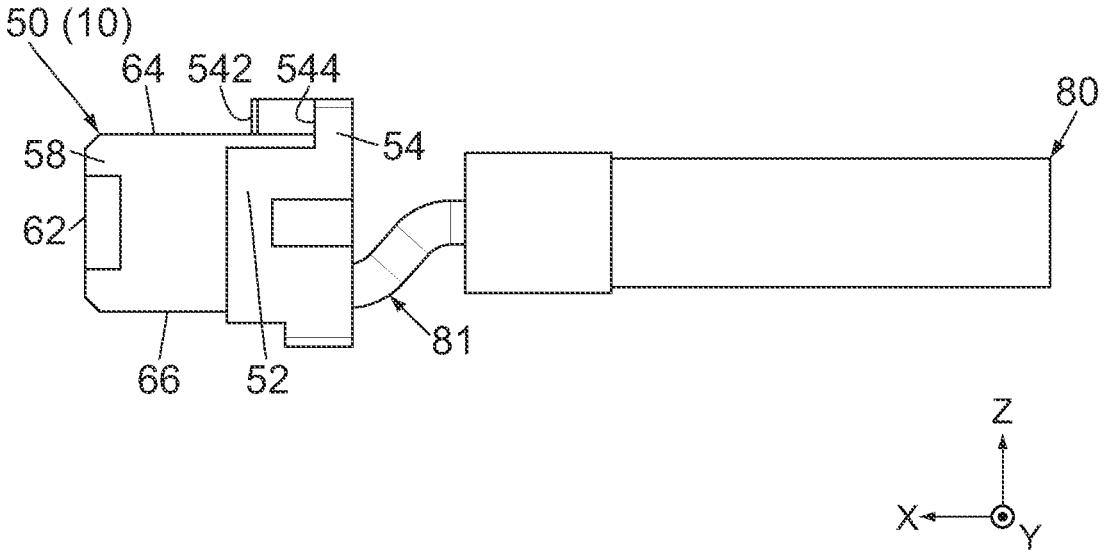
FIG. 5 is a side view showing the locator and the cables of FIG. 4.
Figure 17:
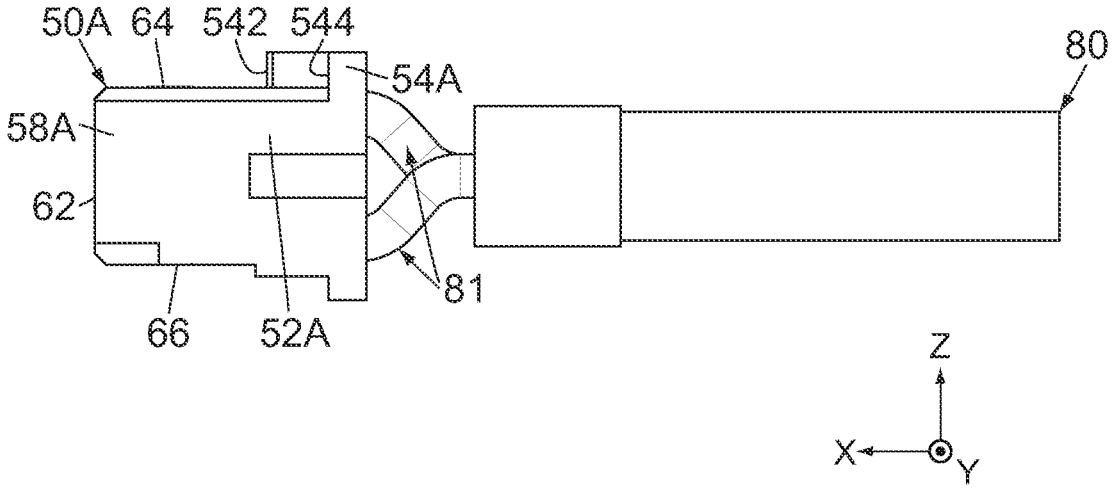
FIG. 17 is a side view showing the locator and the cables of FIG. 16.

For example, referring to FIGS. 4 and 5, the two cables 81 of the aforementioned embodiment are bent and positioned by the locator 50 similarly to each other. However, referring to FIG. 17, the positioning method of the two cables 81 can be modified as described below.

Figure 14:
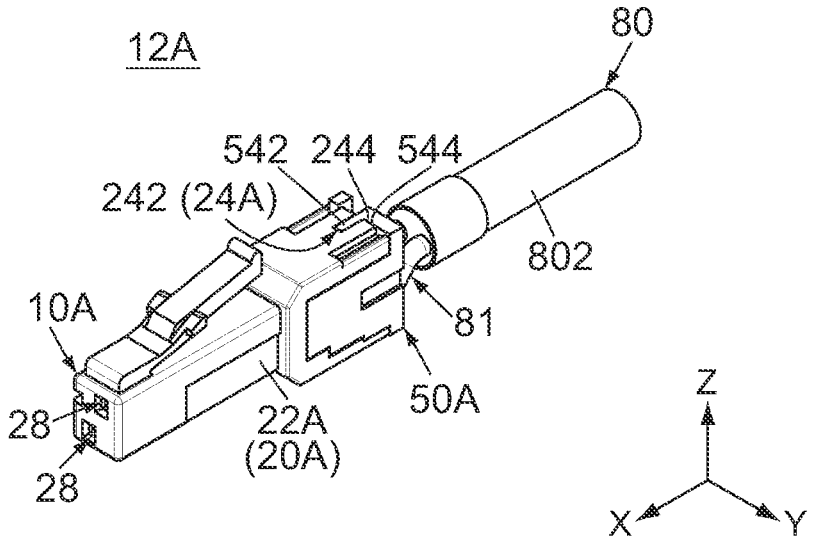
FIG. 14 is a perspective view showing a modification of the connector of FIG. 1 together with the cables, wherein the connector is connected to the cables.
Figure 15:
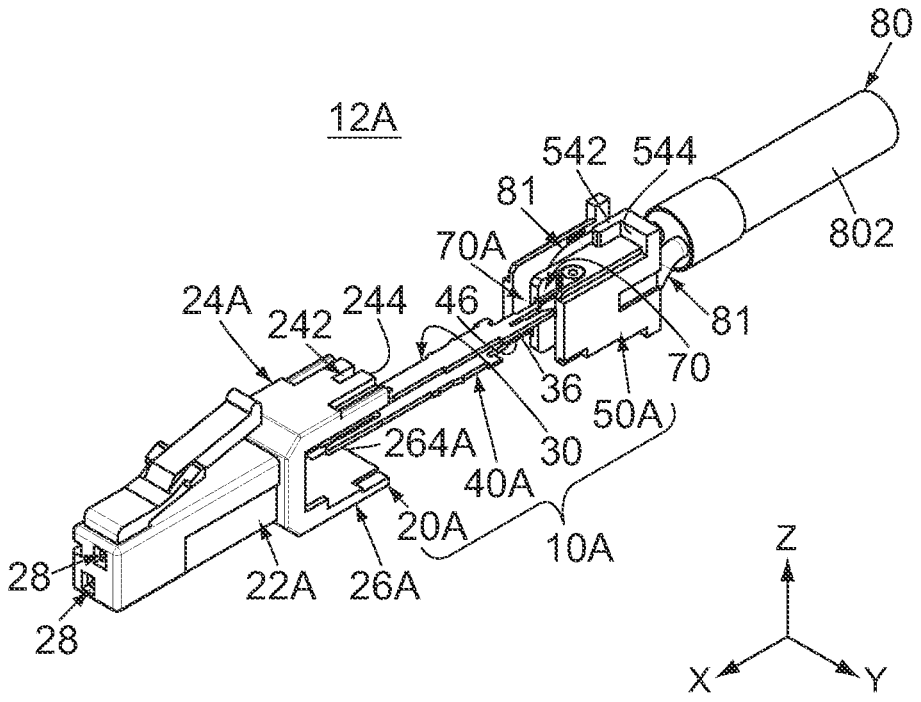
FIG. 15 an exploded, perspective view showing the connector and the cables of FIG. 14.

Referring to FIGS. 14 and 15, a connector 10A according to a modification of the aforementioned embodiment is connected to the two cables 81 when used. The connector 10A forms a harness 12A together with the cables 81. Thus, the harness 12A comprises the connector 10A and the cables 81. The connector 10A comprises a housing 20A made of insulator, two contacts 30 and 40A each made of conductor and a locator 50A made of insulator. The locator 50A is configured to position the two cables 81. The two contacts 30 and 40A are provided so as to correspond to the two cables 81, respectively. The housing 20A holds the contacts 30 and 40A and the locator 50A.

Hereafter, explanation will be made about the connector 10A of the present modification. The explanation described below will be mainly made about difference from the connector 10 (see FIG. 1).

As shown in FIG. 15, the housing 20A has a body 22A, a first protruding portion 24A and a second protruding portion 26A. The body 22A extends along the X-direction. Each of the first protruding portion 24A and the second protruding portion 26A has a flat-plate shape in parallel to the XY-plane. The first protruding portion 24A protrudes rearward from an upper end of the body 22A. The second protruding portion 26A protrudes rearward from a lower end of the body 22A.

The housing 20A is formed with the guide portion 242. The guide portion 242 of the present modification is a recess formed in the first protruding portion 24A and has a structure similar to that of the guide portion 242 (see FIG. 2) of the housing 20. The housing 20A has one catch portion 244 and one catch portion 264A. The catch portion 244 is a rear surface of the first protruding portion 24A and faces rearward. The catch portions 264A is a rear surface of the second protruding portion 26A and faces rearward. The guide portion 242 is located between the catch portion 244 and the catch portion 264A in the Y-direction.

The contact 30 of the present modification is a member same as that of the connector 10 (see FIG. 2). On the other hand, the contact 40A is a member different from the contact 40 (see FIG. 2) of the connector 10. The contact 40A is formed of a single metal plate with no bend and has the connection portion 46 same as that of the contact 40. The connection portion 36 of the contact 30 and the connection portion 46 of the contact 40A are located at positions different from each other in each of the Z-direction and the Y-direction. The connection portions 36 and 46 are provided so as to correspond to the two cables 81, respectively. Each of the connection portions 36 and 46 is connectable to the corresponding cable 81, which is moved along the X-direction, through insulation displacement connection.

Figure 18:
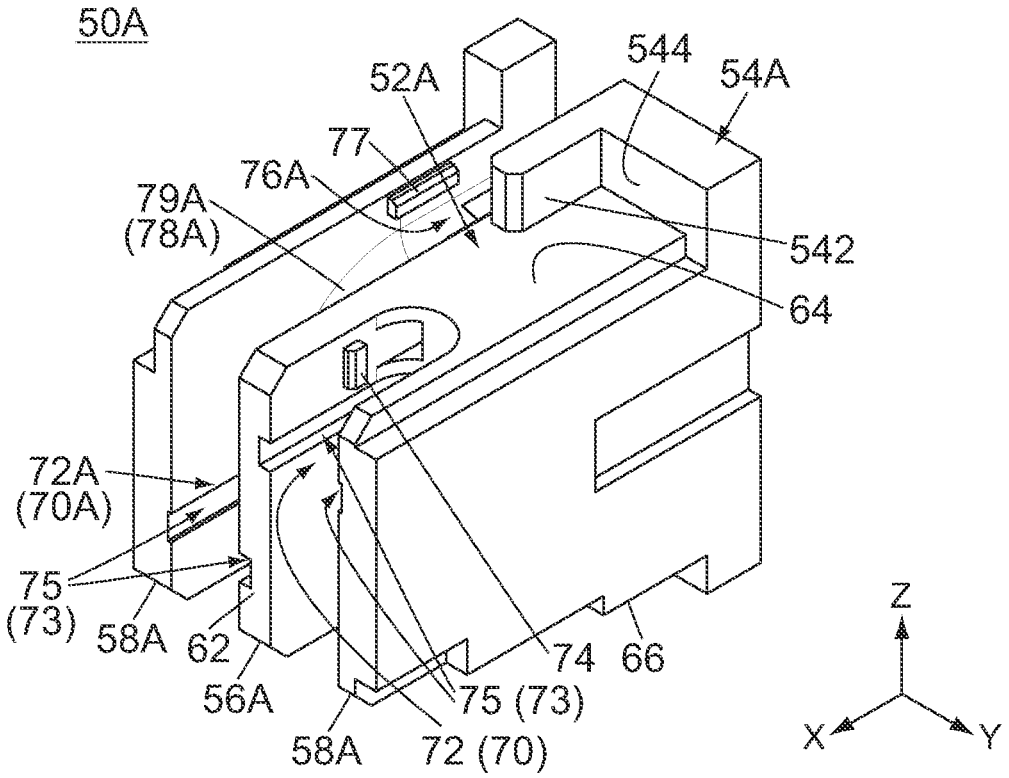
FIG. 18 is a perspective view showing the locator of FIG. 16.
Figure 19:
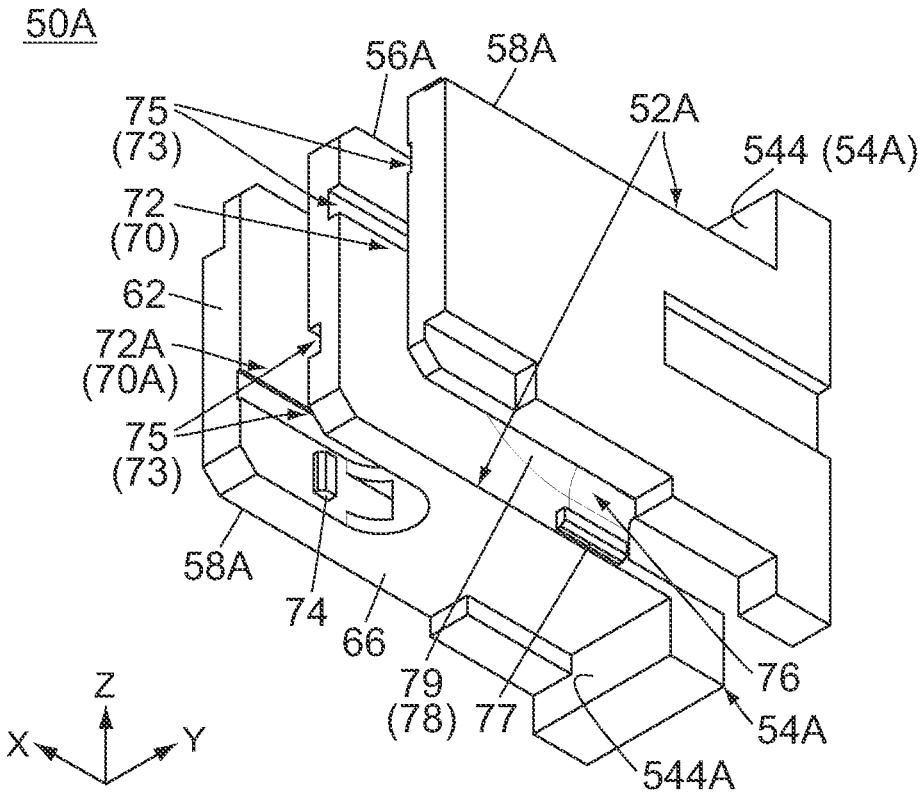
FIG. 19 is another perspective view showing the locator of FIG. 18.

Referring to FIGS. 18 and 19, the locator 50A has a base portion 52A, a rear portion 54A, a middle plate 56A and two side plates 58A. The base portion 52A has a block shape. The rear portion 54A is located rearward of the base portion 52A. Each of the middle plate 56A and the side plates 58A has a flat-plate shape in parallel to the XZ-plane. The middle plate 56A and the side plates 58A are arranged in the Y-direction while they are apart from each other. The middle plate 56A is located at a middle position between the two side plates 58A in the Y-direction. The middle plate 56A protrudes forward from the base portion 52A. One of the side plates 58A, or the positive Y-side plate 58A of the locator 50A, protrudes forward and downward from the base portion 52A. A remaining one of the side plates 58A, or the negative Y-side plate 58A of the locator 50A, protrudes forward and upward from the base portion 52A.

The locator 50A has the front-end surface 62, the first surface 64 and the second surface 66. The front-end surface 62 is located at a front end of the locator 50A. The first surface 64 and the second surface 66 are located at opposite sides of the locator 50A in the Z-direction, respectively. The first surface 64 of the present modification includes an upper surface of the base portion 52A, an upper surface of the middle plate 56A and upper surfaces of the side plates 58A of the locator 50A. The second surface 66 of the present modification includes a lower surface of the base portion 52A, a lower surface of the middle plate 56A and lower surfaces the side plates 58A of the locator 50A. The rear portion 54A of the locator 50A protrudes outward in the Z-direction from each of the first surface 64 and the second surface 66 of the base portion 52A. More specifically, the rear portion 54A protrudes upward beyond the first surface 64 and protrudes downward beyond the second surface 66.

Figure 16:
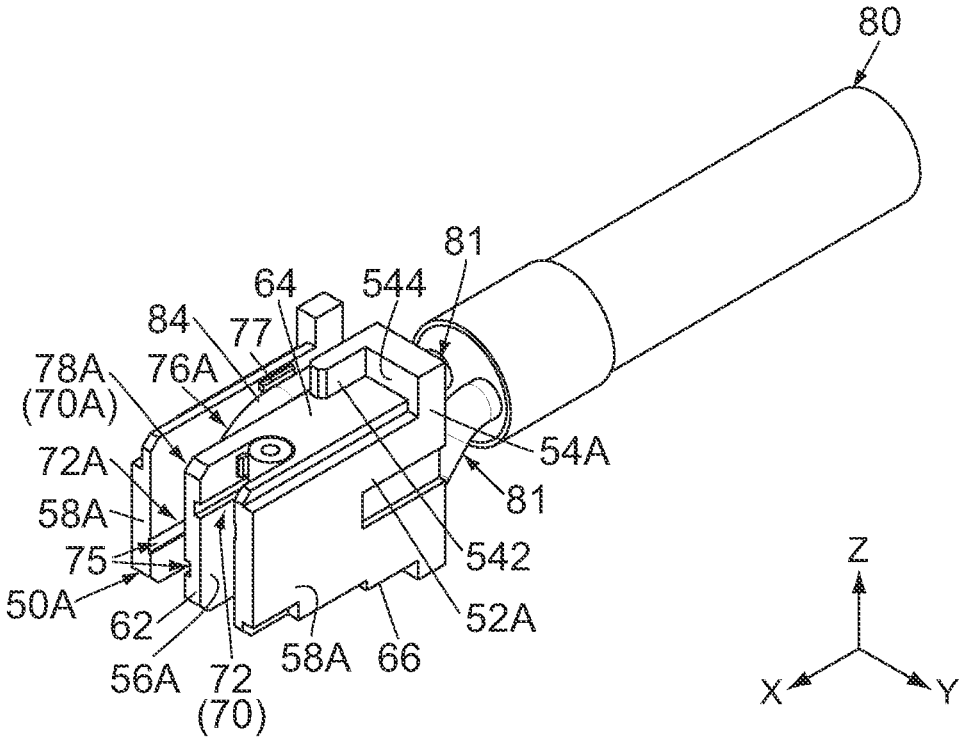
FIG. 16 is a perspective view showing a locator of the connector of FIG. 14 together with the cables, wherein the locator positions the cables.
Figure 21:
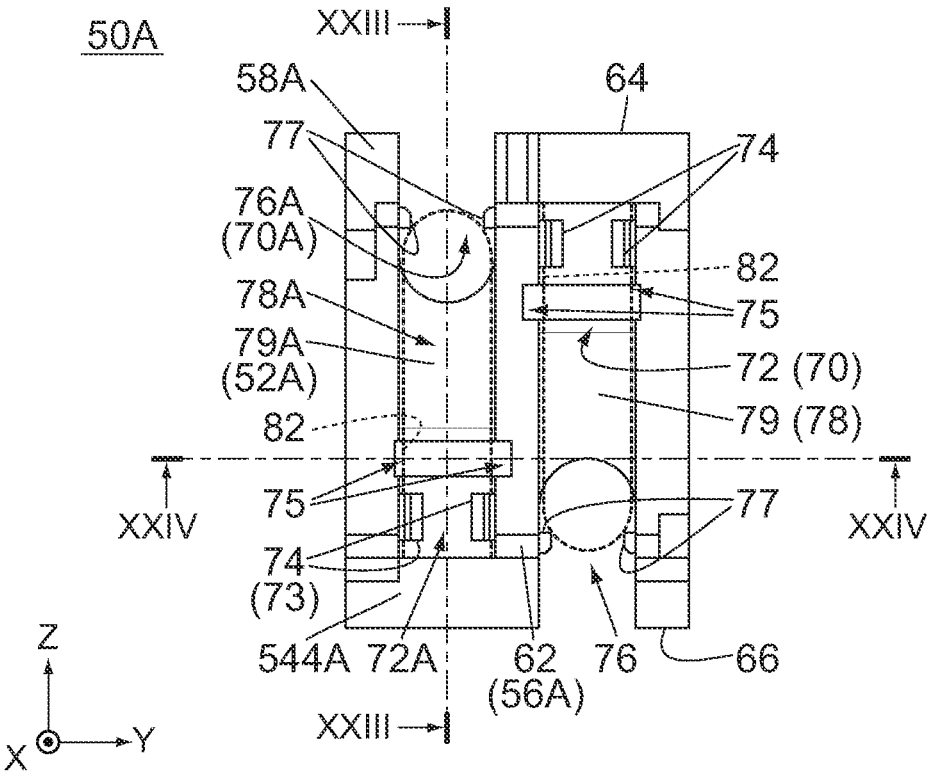
FIG. 21 is a front view showing the locator of FIG. 18, wherein outlines of parts of the cables are illustrated with dashed line.
Figure 22:
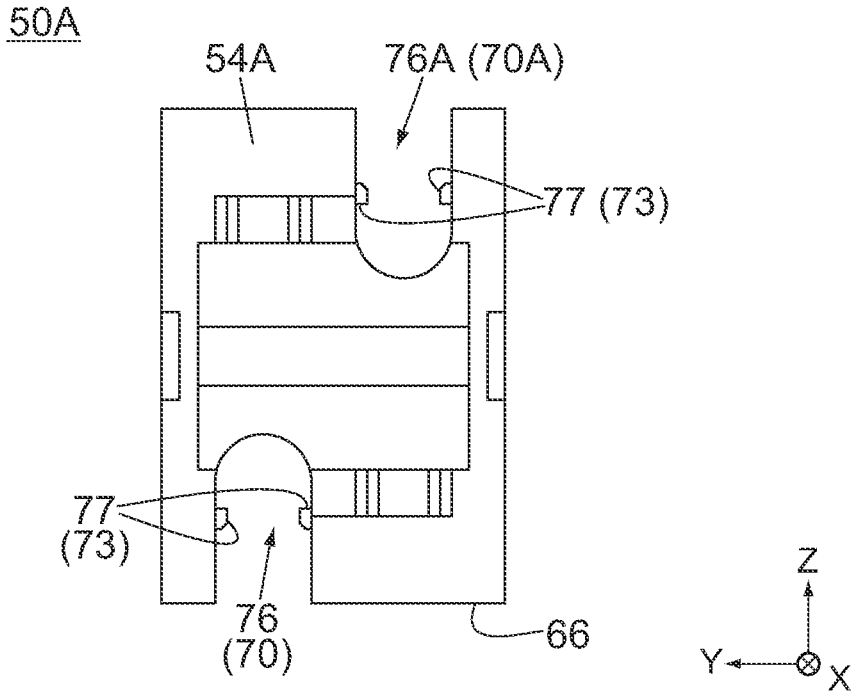
FIG. 22 is a rear view showing the locator of FIG. 18.

Referring to FIG. 16, the locator 50A is formed with one positioning groove 70 and one reversed positioning groove 70A which correspond to the two cables 81, respectively. The reversed positioning groove 70A is a portion for positioning the corresponding cable 81 to the connector 10A similarly to the positioning groove 70. The positioning groove 70 and the reversed positioning groove 70A are arranged in the Y-direction. The positioning groove 70 of the present modification has a structure similar to that of one of the positioning grooves 70 (see FIG. 4) of the locator 50 (see FIG. 4) and works similarly. Referring to FIGS. 21 and 22, the reversed positioning groove 70A has a structure which is obtained by turning the positioning groove 70 upside-down.

Hereafter, explanation will be made about the reversed positioning groove 70A.

Referring to FIGS. 18 and 19, the reversed positioning groove 70A is a groove which is located inward of one of the side plates 58A, or the negative Y-side plate 58A. The reversed positioning groove 70A extends around the base portion 52A in the XZ-plane. The reversed positioning groove 70A is located between the two inner walls 73 in the Y-direction. One of the inner walls 73 is a side surface of the middle plate 56A. A remaining one of the inner walls 73 is a side surface of the side plate 58A. Referring to FIG. 16, the reversed positioning groove 70A has a size in the Y-direction which is slightly larger than the wire diameter of the cable 81, i.e., the size of the cable 81 in the Y-direction.

Figure 23:
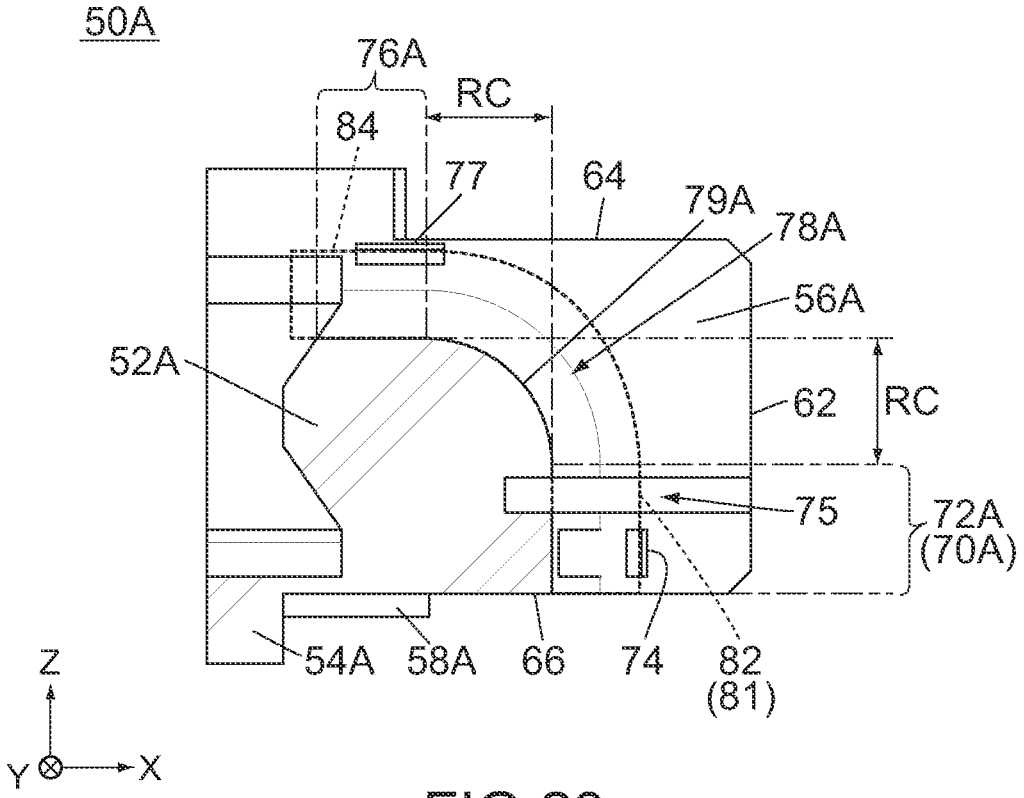
FIG. 23 is a cross-sectional view showing the locator of FIG. 21, taken along line XXIII-XXIII, wherein an outline of a part of the cable is illustrated with dashed line.
Figure 24:
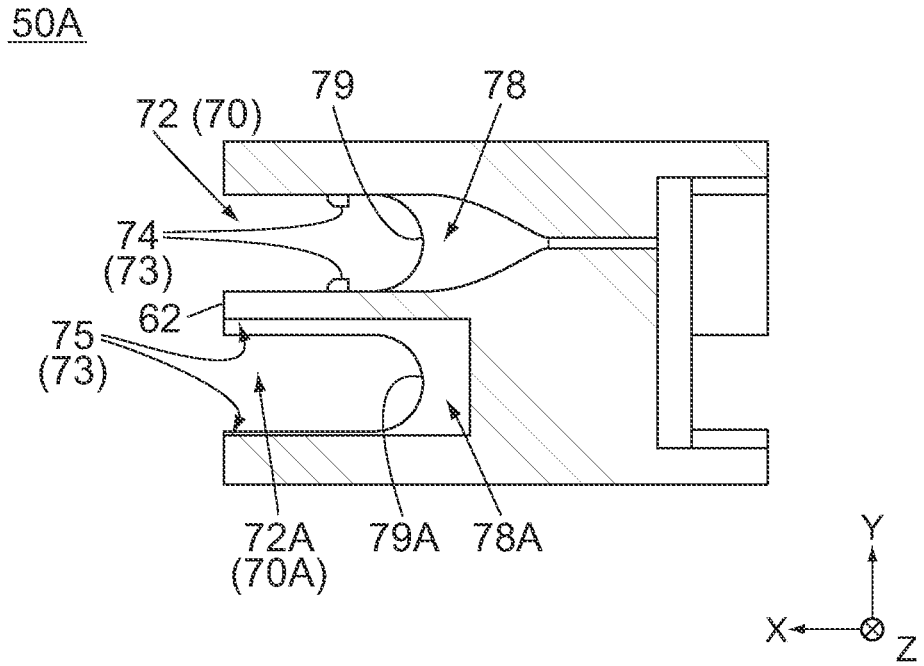
FIG. 24 is a cross-sectional view showing the locator of FIG. 21, taken along line XXIV-XXIV.
Figure 25:
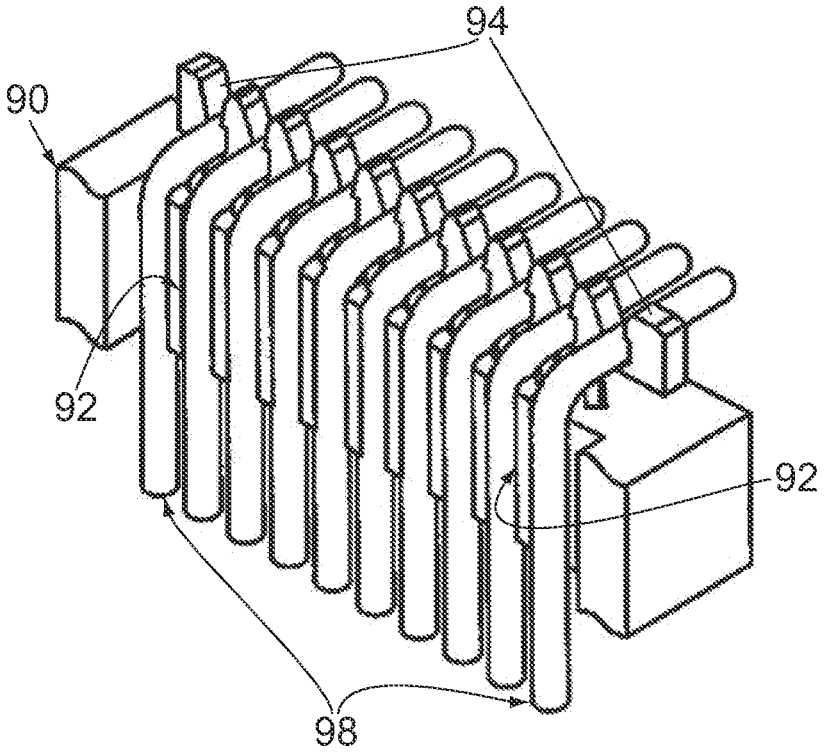
FIG.25 PRIOR ART
FIG. 25 is a perspective view showing a locator of Patent Document 1 together with cables.

Referring to FIG. 23, the reversed positioning groove 70A has a front groove 72A, a rear groove 76A and a coupling groove 78A. The front groove 72A is a front part of the reversed positioning groove 70A. The front groove 72A extends along the Z-direction and opens at the second surface 66. The rear groove 76A is a rear part of the reversed positioning groove 70A. The rear groove 76A extends along the X-direction and opens rearward. The coupling groove 78A is a middle part of the reversed positioning groove 70A and couples the front groove 72A and the rear groove 76A to each other. Thus, the front groove 72A extends from the second surface 66 to the coupling groove 78A along the Z-direction. The rear groove 76A extends rearward from the coupling groove 78A to open rearward.

Referring to FIGS. 18 and 23, the front groove 72A is recessed rearward from the front-end surface 62 to the base portion 52A. The rear groove 76A is recessed from the first surface 64 toward the second surface 66 in the Z-direction. The rear groove 76A is recessed to the base portion 52A in the Z-direction. Thus, each of the front groove 72A and the rear groove 76A is a recess with a bottom. The coupling groove 78A opens forward and opens toward the first surface 64 in the Z-direction. The front groove 72A opens forward over its entire length. The rear groove 76A opens toward the first surface 64 over its entire length.

According to the structure described above, the reversed positioning groove 70A opens outward of the locator 50A over its entire length. Therefore, when the locator 50A alone, i.e., the locator 50A which does not position the cables 81 and is not attached to the housing 20A (see FIG. 15), is seen from the front, the front groove 72A is visible, and the rear groove 76A is visible through the coupling groove 78A. When the locator 50A alone is seen from the first surface 64 along the Z-direction, the rear groove 76A is visible, and the front groove 72A is visible through the coupling groove 78A.

Referring to FIG. 15, upon fabrication of the connector 10A, first, the cables 81 are received in the positioning groove 70 and the reversed positioning groove 70A of the locator 50A, respectively, to be positioned. Hereafter, explanation will be made about the reversed positioning groove 70A which receives the cable 81.

Figure 20:
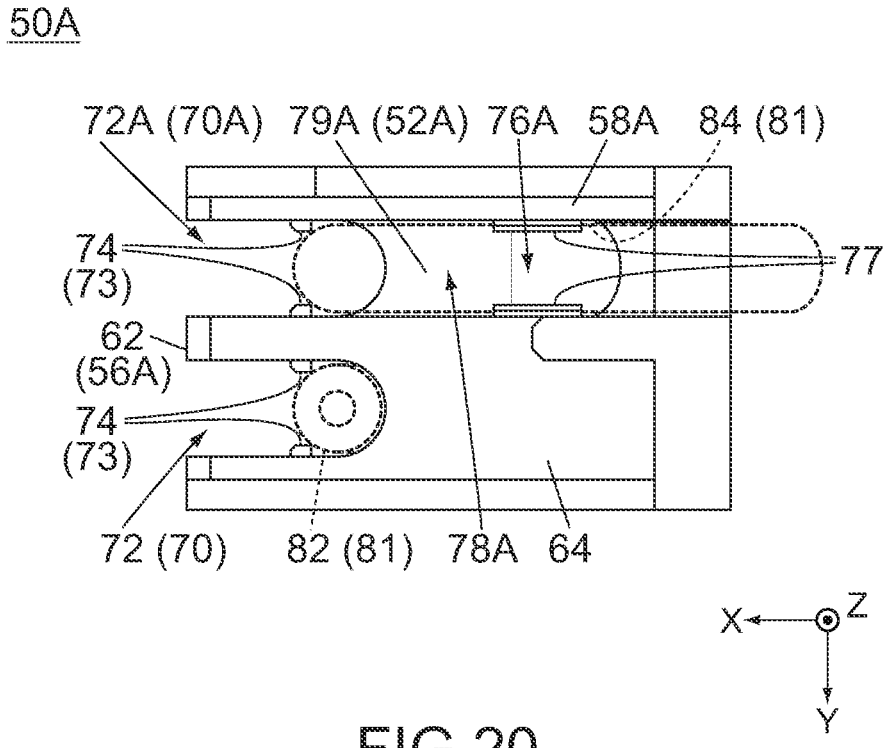
FIG. 20 is a top view showing the locator of FIG. 18, wherein outlines of parts of the cables are illustrated with dashed line.

Referring to FIGS. 16, 20 and 21, when the cable 81 is positioned by the locator 50A, the front groove 72A receives the front regulated portion 82 which is a part of the cable 81, and the rear groove 76A receives the rear regulated portion 84 which is another part of the cable 81.

Referring to FIGS. 21 and 23, the front regulated portion 82, which is received in the front groove 72A, is in contact with the base portion 52A in the X-direction or is located forward of the base portion 52A with a slight distance therefrom. In addition, the front regulated portion 82, which is received in the front groove 72A, is located between the middle plate 56A and the side plate 58A in the Y-direction with a slight distance therefrom. Thus, the front groove 72A, which receives the front regulated portion 82, regulates a rearward movement of the front regulated portion 82 and regulates a movement of the front regulated portion 82 in the Y-direction.

Referring to FIGS. 20 and 23, the rear regulated portion 84, which is received in the rear groove 76A, is in contact with the base portion 52A in the Z-direction or is located between the base portion 52A and the first surface 64 with a slight distance from the base portion 52A. In addition, the rear regulated portion 84, which is received in the rear groove 76A, is located between the middle plate 56A and the side plate 58A in the Y-direction with a slight distance therefrom. Thus, the rear groove 76A, which receives the rear regulated portion 84, regulates a movement of the rear regulated portion 84 toward the second surface 66 and regulates another movement of the rear regulated portion 84 in the Y-direction.

Referring to FIG. 23, as described above, the reversed positioning groove 70A of the locator 50A of the present modification has the front groove 72A which extends along the Z-direction, the rear groove 76A which extends along the X-direction and the coupling groove 78A which couples the front groove 72A and the rear groove 76A to each other. The cable 81 can be smoothly and properly bent by only having it partially receptive into the reversed positioning groove 70A. In particular, even in an instance where the size of the locator 50A is small, the cable 81 can be properly bent with no exceed stress applied to the cable 81. Thus, the present modification also provides the locator 50A having a structure which enables the cable 81 to be bent properly and enables the locator 50A to be reduced in size.

The coupling groove 78A of the present modification has a bottom surface 79A. The bottom surface 79A is a wall surface of the base portion 52A in the XZ-plane. The bottom surface 79A is located rearward of the front groove 72A and is nearer to the second surface 66 in the Z-direction than the rear groove 76A is. The bottom surface 79A of the present modification has an arc shape in the XZ-plane. The radius RC of the arc of the bottom surface 79A is larger than a size of the front regulated portion 82 of the cable 81 in the X-direction, i.e., the wire diameter of the cable 81. According to this structure, the cable 81 can be smoothly and properly bent along the bottom surface 79A.

Referring to FIGS. 19 and 21, the front groove 72A is provided with the two front holding portions 74. The front holding portions 74 are protrusions which are formed on the two inner walls 73 of the reversed positioning groove 70A, respectively. Each of the front holding portions 74 protrudes from the inner wall 73 into the front groove 72A in the Y-direction and extends along the Z-direction. When the front groove 72A receives the front regulated portion 82 of the cable 81, the front holding portions 74 hold the front regulated portion 82.

Referring to FIGS. 18 and 20, the rear groove 76A is provided with the two rear holding portions 77. The rear holding portions 77 are protrusions which are formed on the two inner walls 73 of the reversed positioning groove 70A, respectively. Each of the rear holding portions 77 protrudes from the inner wall 73 into the rear groove 76A in the Y-direction and extends along the X-direction. When the rear groove 76A receives the rear regulated portion 84 of the cable 81, the rear holding portions 77 hold the rear regulated portion 84.

Referring to FIG. 15, the locator 50A which positions the cables 81 is moved forward to be inserted into the housing 20A and is thereby attached to the housing 20A. Hereafter, explanation will be made about an attachment operation of the locator 50A to the housing 20A.

As shown in FIG. 18, the locator 50A has the guided portion 542. The guided portion 542 of the present modification is a protruding portion which is formed on the first surface 64 of the base portion 52A and has a structure similar to that of the guided portion 542 (see FIG. 8) of the locator 50 (see FIG. 8). Referring to FIGS. 14 and 15, when the locator 50A is moved toward the housing 20A, the locator 50A is partially received in the housing 20A. Thereafter, the guided portion 542 is received in the guide portion 242 so that the locator 50A is inserted into the housing 20A with no displacement in the Y-direction. Thus, the connector 10A has a positioning mechanism similar to that of the connector 10 (see FIGS. 1 and 2).

Referring to FIGS. 18, 19, 21 and 24, the locator 50A is formed with four guide channels 75. Two of the four guide channels 75 are formed in the inner walls 73 of the front groove 72 of the positioning groove 70 in the Y-direction, respectively. The other two of the four guide channels 75 are formed in the inner walls 73 of the front groove 72A of the reversed positioning groove 70A in the Y-direction, respectively. Each of the guide channels 75 is recessed in the Y-direction and extends along the X-direction. The guide channels 75 of the positioning groove 70 are nearer to the first surface 64 than to the second surface 66 in the Z-direction. The guide channels 75 of the reversed positioning groove 70A are nearer to the second surface 66 than to the first surface 64 in the Z-direction.

Referring to FIG. 21 together with FIG. 15, the guide channels 75 of the positioning groove 70 are provided so as to correspond to the connection portion 36 of the contact 30. The guide channels 75 of the reversed positioning groove 70A are provided so as to correspond to the connection portion 46 of the contact 40A. Upon insertion of the locator 50A into the housing 20A, each of the guide channels 75 partially receives the corresponding connection portion 36 or 46 and guides it to the front regulated portion 82 of the corresponding cable 81 along the X-direction. Thus, each of the guide channels 75 is a portion for guiding the connection portion 36 or 46 of the contact 30 or 40A. According to the present modification, since each of the front grooves 72 and 72A is provided with the two guide channels 75 which extend straight in the X-direction, each of the connection portions 36 and 46 can be further accurately guided to the corresponding front regulated portion 82 to be further reliably connected to the cable 81 through insulation displacement connection.

Referring to FIGS. 18 and 19, the locator 50A has one abutment portion 544 and one abutment portion 544A. The abutment portion 544 is a front surface of a part of the rear portion 54A of the locator 50A which protrudes beyond the first surface 64. The abutment portion 544 is located rearward of the front groove 72 and protrudes outward in the Z-direction from the first surface 64. The abutment portion 544A is a front surface of a part of the rear portion 54A of the locator 50A which protrudes beyond the second surface 66. The abutment portion 544A is located rearward of the front groove 72A and protrudes outward in the Z-direction from the second surface 66.

Referring to FIG. 15 together with FIG. 19, the abutment portions 544 and 544A are provided so as to correspond to the catch portions 244 and 264A of the housing 20A, respectively. During the insertion of the locator 50A into the housing 20A, the abutment portions 544 and 544A face the catch portions 244 and 264A in the X-direction, respectively. Referring to FIG. 14 together with FIGS. 15 and 19, when the insertion of the locator 50A into the housing 20A is continued, the abutment portions 544 and 544A are brought into abutment with the catch portions 244 and 264A, respectively. At that time, the locator 50A is attached to and held by the housing 20A. When the locator 50A is attached to the housing 20A, the catch portions 244 and 264A face the abutment portions 544 and 544A in the X-direction, respectively.

Each of the connection portions 36 and 46 is moved relative to the locator 50A along a moving path. Each of the abutment portions 544 and 544A of the present modification is arranged in the vicinity of the moving path in the XY-plane. According to this arrangement, an operator can connect each of the connection portions 36 and 46 to the cable 81 through insulation displacement connection by merely pushing the locator 50 into the housing 20.

The connector 10A of the present modification has the aforementioned structure. However, the present invention is not limited thereto. For example, the connector 10A can be modified similarly to the connector 10 (see FIG. 1).

What is claimed is:

1. A connector configured to be connected to a cable, wherein:

the connector comprises a housing, a contact and a locator configured to position the cable;

the housing holds the contact and the locator;

the contact has a connection portion;

the connection portion is connectable to the cable, which is moved along a front-rear direction, through insulation displacement connection;

the locator has a front-end surface, a first surface and a second surface and is formed with a positioning groove;

the front-end surface is located at a front end of the locator;

the first surface and the second surface are located at opposite sides of the locator, respectively, in an upper-lower direction perpendicular to the front-rear direction;

the positioning groove has a front groove, a rear groove and a coupling groove;

the front groove is recessed rearward from the front-end surface and extends from the first surface to the coupling groove along the upper-lower direction;

the rear groove is recessed from the second surface toward the first surface along the upper-lower direction and extends rearward from the coupling groove to open rearward;

the coupling groove opens forward and opens toward the second surface in the upper-lower direction;

when the locator positions the cable, the front groove receives a front regulated portion which is a part of the cable, and the rear groove receives a rear regulated portion which is another part of the cable;

the front groove, which receives the front regulated portion, regulates a rearward movement of the front regulated portion and regulates a movement of the front regulated portion in a lateral direction perpendicular to both the front-rear direction and the upper-lower direction;

the rear groove, which receives the rear regulated portion, regulates a movement of the rear regulated portion toward the first surface and regulates another movement of the rear regulated portion in the lateral direction;

the coupling groove has a bottom surface; and the bottom surface is located rearward of the front groove and is nearer to the first surface in the upper-lower direction than the rear groove is.

2. The connector as recited in claim 1, wherein:

the front groove is provided with a front holding portion;

the rear groove is provided with a rear holding portion;

when the front groove receives the front regulated portion of the cable, the front holding portion holds the front regulated portion; and when the rear groove receives the rear regulated portion of the cable, the rear holding portion holds the rear regulated portion.

3. The connector as recited in claim 1, wherein the bottom surface has an arc shape in a vertical plane defined by the front-rear direction and the upper-lower direction.

4. The connector as recited in claim 1, wherein:

the locator is formed with a guide channel for guiding the connection portion of the contact; and the guide channel is formed in an inner wall of the front groove in the lateral direction, recessed in the lateral direction and extends along the front-rear direction.

5. The connector as recited in claim 1, wherein:

the locator has an abutment portion;

the abutment portion is located rearward of the front groove and protrudes outward from the first surface in the upper-lower direction;

the housing has a catch portion; and the catch portion faces the abutment portion in the front-rear direction.

6. The connector as recited in claim 1, wherein:

the locator is formed with a reversed positioning groove;

the reversed positioning groove has a structure which is obtained by turning the positioning groove upside-down; and the positioning groove and the reversed positioning groove are arranged in the lateral direction.

7. The connector as recited in claim 1, wherein:

the positioning groove includes two positioning grooves; and the two positioning grooves are arranged in the lateral direction.

8. A connector configured to be connected to a cable, wherein:

the connector comprises a housing, a contact and a locator configured to position the cable;

the housing holds the contact and the locator;

the contact has a connection portion;

the connection portion is connectable to the cable, which is moved along a front-rear direction, through insulation displacement connection;

the locator has a front-end surface, a first surface and a second surface and is formed with a positioning groove;

the front-end surface is located at a front end of the locator;

the first surface and the second surface are located at opposite sides of the locator, respectively, in an upper-lower direction perpendicular to the front-rear direction;

the positioning groove has a front groove, a rear groove and a coupling groove;

the front groove is recessed rearward from the front-end surface and extends from the first surface to the coupling groove along the upper-lower direction;

the rear groove is recessed from the second surface toward the first surface along the upper-lower direction and extends rearward from the coupling groove to open rearward;

the coupling groove opens forward and opens toward the second surface in the upper-lower direction;

when the locator positions the cable, the front groove receives a front regulated portion which is a part of the cable, and the rear groove receives a rear regulated portion which is another part of the cable;

the front groove, which receives the front regulated portion, regulates a rearward movement of the front regulated portion and regulates a movement of the front regulated portion in a lateral direction perpendicular to both the front-rear direction and the upper-lower direction;

the rear groove, which receives the rear regulated portion, regulates a movement of the rear regulated portion toward the first surface and regulates another movement of the rear regulated portion in the lateral direction;

the locator has an abutment portion;

the abutment portion is located rearward of the front groove and protrudes outward from the first surface in the upper-lower direction;

the housing has a catch portion; and the catch portion faces the abutment portion in the front-rear direction.

9. A connector configured to be connected to a cable, wherein:

the connector comprises a housing, a contact and a locator configured to position the cable;

the housing holds the contact and the locator;

the contact has a connection portion;

the connection portion is connectable to the cable, which is moved along a front-rear direction, through insulation displacement connection;

the locator has a front-end surface, a first surface and a second surface and is formed with a positioning groove;

the front-end surface is located at a front end of the locator;

the first surface and the second surface are located at opposite sides of the locator, respectively, in an upper-lower direction perpendicular to the front-rear direction;

the positioning groove has a front groove, a rear groove and a coupling groove;

the front groove is recessed rearward from the front-end surface and extends from the first surface to the coupling groove along the upper-lower direction;

the rear groove is recessed from the second surface toward the first surface along the upper-lower direction and extends rearward from the coupling groove to open rearward;

the coupling groove opens forward and opens toward the second surface in the upper-lower direction;

when the locator positions the cable, the front groove receives a front regulated portion which is a part of the cable, and the rear groove receives a rear regulated portion which is another part of the cable;

the front groove, which receives the front regulated portion, regulates a rearward movement of the front regulated portion and regulates a movement of the front regulated portion in a lateral direction perpendicular to both the front-rear direction and the upper-lower direction;

the rear groove, which receives the rear regulated portion, regulates a movement of the rear regulated portion toward the first surface and regulates another movement of the rear regulated portion in the lateral direction;

the locator is formed with a reversed positioning groove;

the reversed positioning groove has a structure which is obtained by turning the positioning groove upside-down; and the positioning groove and the reversed positioning groove are arranged in the lateral direction.

* * * * *